US005626452A

United States Patent [19]

Hawkes

[11] Patent Number: 5,626,452

[45] Date of Patent: May 6, 1997

[54] METHOD OF APPLYING COVERS TO BOOKS

[75] Inventor: Richard B. Hawkes, Bethlehem, Pa.

[73] Assignee: Heidelberg Finishing Systems, Inc., Dayton, Ohio

[21] Appl. No.: 495,717

[22] Filed: Jun. 27, 1995

Related U.S. Application Data

[62] Division of Ser. No. 161,932, Dec. 3, 1993, Pat. No. 5,441,375.

[51] Int. Cl.[6] ..... B42C 11/00

[52] U.S. Cl. ..... 412/4

[58] Field of Search ..... 412/4, 5, 19, 21, 412/22

[56] References Cited

U.S. PATENT DOCUMENTS

| | | |
|---|---|---|
| 2,083,720 | 6/1937 | Lariviere . |
| 2,714,732 | 8/1955 | Traettino . |
| 2,893,022 | 7/1959 | Schoenberger, Jr. . |
| 3,451,082 | 6/1969 | Sarring . |
| 3,469,270 | 9/1969 | Thorp . |
| 3,771,185 | 11/1973 | Thorp et al. . |
| 4,153,963 | 5/1979 | Hawkes et al. . |
| 5,061,138 | 10/1991 | Allsopp et al. . |
| 5,104,275 | 4/1992 | Rathert . |

*Primary Examiner*—S. Thomas Hughes
*Attorney, Agent, or Firm*—Tarolli, Sundheim, Covell, Tummino & Szabo

[57] ABSTRACT

An improved cover breaker assembly may be used to sequentially apply covers to books of different thicknesses or to books of the same thickness. The cover breaker assembly includes inner and outer breaker members which are engageable with a cover on each of the books in turn. The inner breaker member is moved through the same distance from a retracted position to the same extended position during the application of a cover to either a thin book or a thick book. The outer breaker member is moved from a retracted position to an extended position through a distance which varies as a function of the thickness of the book. The inner and outer breaker members are effective to apply substantially the same force to either a thick book or a thin book. During the application of a cover to either a thick book or a thin book, the inner breaker member moves through the same distance along the path of travel of the book. During the application of a cover to a book, the outer breaker member moves along the path of travel of the book through a distance which varies as a function of the thickness of the book.

18 Claims, 13 Drawing Sheets

METHOD OF APPLYING COVERS TO BOOKS

This is a divisional of application Ser. No. 08/161,932 filed on Dec. 3, 1993, now U.S. Pat. No. 5,441,375.

BACKGROUND OF THE INVENTION

The present invention relates to a new and improved cover breaker assembly and the method of operation of the cover breaker assembly. More specifically, the present invention relates to a cover breaker assembly which may be used to sequentially apply covers to books of different thicknesses or to sequentially apply covers to books of the same thickness.

A known cover breaker assembly has a pair of wings or breaker members which are pressed against opposite sides of a cover on a book, that is, a catalogue, magazine, etc., to shape the backbone of the book. Publishers frequently want to have a book customized for the intended reader of the book. This can result in a greater number of pages being included in a book intended for one reader than in a book intended for another reader.

When it was attempted to use the known cover breaker 20 assembly to sequentially shape the covers on books of different thicknesses, it was found that excessive forces were applied against the thick books by the wings or breaker members, resulting in poor book quality or damage to the cover breakers. In an extreme case, these forces could even crack the base of the known cover breaker assembly.

In an effort to overcome the problems which were encountered in using the known cover breaker assembly to sequentially apply covers to books of different thicknesses, it was suggested that the known cover breaker assembly be modified in the manner disclosed in U.S. Pat. No. 5,061,138. This patent teaches that the thickness of each of the books is to be sensed. The cover breaker assembly is then to be adjusted to accommodate a book having the sensed thickness.

SUMMARY OF THE INVENTION

The present invention provides a new and improved cover breaker assembly and method which may be used to apply covers to books of the same thickness or to sequentially apply covers to books of different thicknesses. The cover breaker assembly has inner and outer breaker members which are sequentially moved into engagement with a cover on a book. Thereafter, the breaker members are moved in the same direction and at the same speed as the book.

One of the breaker members is moved into engagement with a side of the book at the same location and is then moved forward with the book through the same distance regardless of whether the book is a thin book or a thick book. The other breaker member engages the book at a different location and is moved forward with the book through a distance which varies depending upon whether the book is a thin book or a thick book. Thus, if the book is a thin book, the second breaker member engages the book and moves through a short distance with the book. However, if the book is a thick book, the second breaker member engages the book earlier in the operating cycle and then moves through a relatively long distance with the book.

To accommodate the sequential application of covers to books of different thicknesses and to apply substantially the same effective force to the books of different thicknesses, the second breaker member is movable relative to a carrier against the influence of a biasing force. The second breaker member is moved relative to the carrier after the second breaker member has engaged the book.

BRIEF DESCRIPTION OF THE DRAWINGS

The foregoing and other features of the present invention will become more apparent upon a consideration of the following description taken in connection with the accompanying drawings, wherein.

DESCRIPTION OF A SPECIFIC PREFERRED EMBODIMENT OF THE INVENTION

General Description

A cover breaker assembly 20 (FIG. 1) constructed in accordance with the present invention is used to press the back and opposite sides of a cover against the backbone of a book. Pressing the back and opposite sides of the cover against the backbone of the book results in the book having a tight, square back. The cover breaker assembly 20 may be used in association with many different types of books. The books may be magazines, catalogues, pocket books, etc.

Before the book reaches the cover breaker assembly 20, the book is gripped in a known manner by a book clamp assembly in an overhead conveyor. The book is supported, by the clamp assembly, with the backbone of the book downward and exposed. A rotary knife cuts off folds at the exposed backbone of the book. The book is then conveyed to a station where the backbone of the book is roughened. Adhesive is then applied to the toughened back of the book.

A cover feeder sequentially feeds a cover to a cover application station in registered relationship with the book. The cover is applied to the backbone of the book with opposite sides of the cover outside of the clamp assembly which supports the book. After the cover has been applied to the backbone of the book, the book is moved into the cover breaker assembly 20 with the cover held in place by the adhesive on the backbone of the book.

When the book is in the cover breaker assembly 20, a book carriage 24 moves upward to press the back of the cover against the backbone of the book. This results in the cover being firmly secured to the backbone of the book by the adhesive on the backbone of the book. This also flattens the cover against the backbone of the book. While the book carriage 24 is pressed firmly against the backbone of the book, the book is moved along a linear path between an inner wing or breaker member 28 and an outer wing or breaker member 30.

Figures 2A, 2B, 2C, 2D, 2E, 2F, 3A, 3B, 3C, 3D, 3E, 3F:
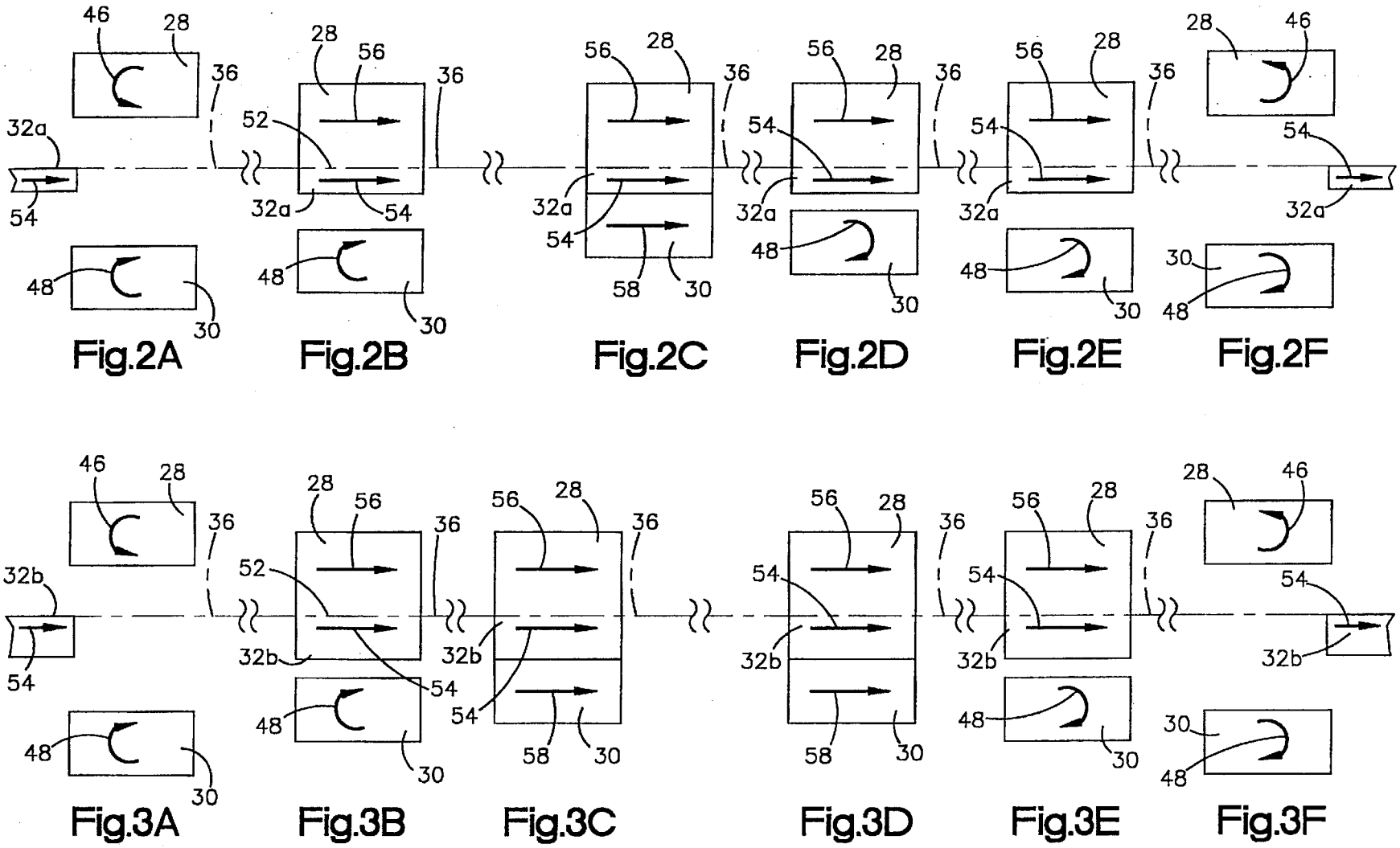
FIGS. 2A, 2B, 2C, 2D, 2E and 2F schematically depict a sequence of events which occur in a continuous manner, to apply a cover to a relatively thin book with the cover breaker assembly of FIG. 1.
FIGS. 3A, 3B, 3C, 3D, 3E, and 3F schematically depict a sequence of events which occur in a continuous manner, to apply a cover to a relatively thick book with the cover breaker assembly of FIG. 1.

The manner in which a thin book 32*a* is moved into the space between the continuously moving inner and outer breaker members 28 and 30 when they are in a retracted condition is illustrated in FIG. 2A. The overhead conveyor moves the thin book 32*a* along a path with an inner side of the book aligned with a reference line 36. The reference line 36 extends through the cover breaker assembly 20 and stations in the book binding apparatus where operations are performed on a book before it reaches the cover breaker assembly 20. Although there may be curves in the reference line 36 before and after the cover breaker assembly 20, the reference line 36 is straight and horizontal immediately before, through, and immediately after the cover breaker assembly 20.

As the thin book 32*a* moves into the cover breaker assembly 20, a continuously operating inner breaker member drive assembly 40 (FIG. 1) moves the inner breaker member 28 from a fully retracted position in which the inner breaker member is spaced from the book 32*a* (FIG. 2A) to a fully extended position in which the inner breaker member 28 engages an inner side of the cover on the book adjacent to the backbone of the book (FIG. 2B). While the inner breaker member 28 is moving into engagement with the thin book 32*a*, the outer breaker member 30 is moved by a continuously operating outer breaker member drive assembly 42 (FIG. 1), toward an outer side of the cover on the book 32*a* (FIG. 2B). However, the inner breaker member 28 moves into engagement with the inner side of the cover on the thin book 32*a* while the outer breaker member 30 is still spaced apart from the outer side of the cover on the book 32*a* and is moving toward the book. The inner breaker member 28 engages the thin book 32*a* before the outer breaker member 30 because the inner breaker member, when in its fully retracted position (FIG. 2A), is closer to the reference line 36 and the book 32*a* than the fully retracted outer breaker member 30.

The inner breaker member drive assembly 40 and the outer breaker member drive assembly 42 (FIG. 1) are continuously operated at the same speed. The inner breaker member drive assembly 40 moves the inner breaker member 28 toward the book 32*a* along an arcuate path, in the manner indicated by the arrow 46 in FIG. 2A. The outer breaker member drive assembly 42 moves the outer breaker member 30 towards the book 32*a* along an arcuate path, in the manner indicated by the arrow 48 in FIG. 2A. Since the inner breaker drive assembly 40 and the outer breaker drive assembly 42 are driven at the same constant speed by a main bindery drive, the inner breaker member 28 is moved along the arcuate path 46 toward the book 32*a* at the same angular speed that the outer breaker member 30 is moved along the arcuate path 48 toward the book.

Once the inner breaker member 28 has moved into engagement with the inner side of the cover on the thin book 32*a* (FIG. 2B), the inner breaker member drive assembly 40 moves the inner breaker member forward along a linear path at the same speed and in the same direction as the thin book 32*a*. The inner breaker member 28 engages the cover on the book 32*a* adjacent to the backbone of the book and moves forward at the same speed and in the same direction as the book 32*a*. It should be understood that the speed of the inner breaker member 28 may not precisely match the speed of the book 32*a* and there may be a negligible difference in the speeds of the inner breaker member and book.

The book 32*a* is continuously moved at a substantially constant speed, indicated by arrow 54 in FIGS. 2A–2F, along the straight reference line 36 by a conveyor clamp (not shown). Once the inner breaker member 28 has moved into engagement with the thin book 32*a* (FIG. 2B), the inner breaker member 28 moves parallel to the straight horizontal reference line 36 at a substantially constant speed indicated by arrows 56 in FIGS. 2B–2E. The substantially constant speed 56 at which the inner breaker member 28 is moving is the same as the constant speed 54 at which the book 32*a* is moving.

After the inner breaker member 28 has engaged the thin book 32*a* (FIG.2B), the outer breaker member drive assembly 42 is still moving the outer breaker member 30 along the arcuate path 48 toward the book. The outer breaker member drive assembly 42 subsequently moves the outer breaker member 30 into engagement with the thin book 32*a* (FIG. 2C). The outer breaker member drive assembly 42 then moves the outer breaker member 30 straight forward in the same direction and at the same speed as the thin book 32*a* and inner breaker member 28.

After the outer breaker member 30 engages the book 32*a*, the outer breaker member drive assembly 42 moves the outer breaker member forward along a path extending parallel to the reference line 36 and at a substantially constant speed, indicated by the arrow 58 in FIG. 2C. The substantially constant speed 58 of movement of the outer breaker member 30 is the same as the substantially constant speed 54 at which the book 32*a* is moving. Thus, once the outer breaker member 30 has moved into engagement with the book 32*a*, the inner breaker member 28, the book 32*a* and the outer breaker member 30 are all moved forward at the same speed in a direction parallel to the straight horizontal reference line 36. It should be understood that the speed of the outer breaker member 30 may not be precisely constant and that there may be a negligible difference between the speed of the outer breaker member 30 and the book.

The outer breaker member 30 moves into engagement with the cover on the thin book 32*a* adjacent to the backbone of the book and applies pressure against the cover to firmly clamp the book between the inner breaker member 28 and outer breaker member 30. The force applied to the back of the cover of the thin book 32*a* by the book carriage 24 (FIG. 1) and the inner and outer breaker members 28 and 30 combine to form a tight, square back on the book.

The outer breaker member drive assembly 42 then moves the outer breaker member 30 away from the thin book 32*a* along the arcuate path 48 (FIG. 2D). As this is occurring, the inner breaker member 28 remains in engagement with the book 32*a*. Thus, the inner breaker member 28 continues to move straight forward at the same speed and in the same direction as the book 32*a*, in the manner indicated schematically by the arrows 54 and 56 in FIGS. 2D and 2E, as the outer breaker member 30 moves away from the book.

While the outer breaker member 30 is still moving away from the thin book 32*a* along the arcuate path 48, the inner breaker member drive assembly 40 initiates movement of the inner breaker member 28 away from the book 32*a* along the arcuate path 46 (FIG. 2F). The thin book 32*a* continues to move straight forward along the reference line 36 in the manner indicated by the arrow 54 in FIG. 2F. The inner and outer breaker member drive assemblies 40 and 42 move the inner and outer breaker members 28 and 30 along the arcuate paths 46 and 48 to their initial or fully retracted positions indicated in FIG. 2A. As this occurs, a next succeeding book is moved into the breaker assembly 20.

In accordance with a feature of the present invention, the cover breaker assembly 20 (FIG. 1) can be used to sequentially apply covers to books of different thicknesses without adjusting the cover breaker assembly. The cover breaker assembly 20 has a thickness adjustment assembly 62 of a known construction. The thickness adjustment assembly 62 is set for a range of book thicknesses. The cover breaker assembly 20 of the present invention, can then be used to apply covers to books of any thickness within the range of thicknesses without changing the setting of the thickness adjustment assembly 62.

In one specific embodiment of the invention, the range of thicknesses to which covers could be applied without actuating the cover thickness adjustment assembly 62 was 0.180 inches. Thus, the thickness of one book processed by the cover breaker assembly could differ from the thickness of the next book processed by the cover breaker assembly by 0.180 inches in this specific embodiment of the invention. It should be understood that the foregoing specific range of variations in book thicknesses has been set forth herein for purposes of clarity of description and not for purposes for limitation of the invention. It is contemplated that cover breaker assemblies constructed in accordance with the present invention will be constructed and operated with different ranges of thicknesses.

A thick book 32*b* (FIGS. 3A, 3B, 3C, 3D, 3E and 3F) may be the book which next follows the thin book 32*a* through the cover breaker assembly 20. The thick book 32*b* is moved into the cover breaker assembly with the inner side of the book aligned with the reference line 36 by the overhead conveyor assembly in the same manner as the thin book 32*a*. The thick book 32*b* is moved at the same speed, indicated by the arrow 54 in FIG. 3A, along the straight reference line 36 as the thin book 32*a*.

As the thick book 32*b* moves into the cover breaker assembly, the back of the cover is engaged by the book carriage 24 and pressed against the backbone of the book. This flattens the back of the cover and presses it firmly against the adhesive on the backbone of the book. At this time, the inner breaker member 28 and the outer breaker member 30 are in retracted positions.

The distance from the reference line 36 and the inner side of the thick book 32*b* to the fully retracted inner breaker member 28 (FIG. 3A) is the same as the distance from the reference line 36 and the inner side of the thin book 32*a* to the fully retracted inner breaker member 28 (FIG. 2A). However, the distance from the outer side of the thick book 32*b* to the fully retracted outer breaker member 30 (FIG. 3A) is less than the distance from the outer side of the relatively thin book 32*a* to the fully retracted outer breaker member 30 (FIG. 2A). The distance from the fully retracted outer breaker member 30 to the reference line 36 is the same in FIGS. 2A and 3A.

The inner breaker member drive assembly 40 moves the inner breaker member 28 into engagement with an inner side of the cover on the thick book 32*b* (FIG. 3B). The inner breaker member 28 engages the inner side of the thick book 32*b* at the same time in the operating cycle as in which the inner breaker member 28 engages the inner side of the thin book 32*a*. This is because the inner breaker member 28 moves through the same distance and at the same speed from the same fully retracted position (FIGS. 2A and 3A) to the same extended position (FIGS. 2B and 3B) regardless of whether a thin book 32*a* or a thick book 32*b* is being processed through the cover breaker assembly 20.

When the inner breaker member 28 moves into engagement with the thick book 32*b* and begins to move straight forward at the same speed as the thick book, the outer breaker member 30 will have moved closer to the outer side of the thick book 32*b* (FIG. 3B) than it was to the outer side of the thin book 32*a* (FIG. 2B) at the same time in the operating cycle. This is because the outer breaker member 30 moves along the arcuate path 48 at the same speed by the outer breaker member drive assembly 42 whether a thin book 32*a* or a thick book 32*b* is being processed. The distance from the fully retracted outer breaker member 30 (FIG. 3A) to the outer side of a thick book 32*b* is less than the distance from the fully retracted outer breaker member 30 to the outer side of a thin book 32*a*. Therefore, the outer breaker member 30 will have moved closer to the outer side of the thick book 32*b* (FIG. 3B) when the inner breaker member 28 engages the inner side of the thick book 32*b* than when the inner breaker member 28 engages the thin book 32*a* (FIG. 2B).

The outer breaker member 30 moves into engagement with the thick book 32*b* (FIG. 3C) at an earlier time in the operating cycle than at which the outer breaker member engages the thin book 32*a* (FIG. 2C). Once the outer breaker member 30 has moved into engagement with the outer side of the thick book 32*b* (FIG. 3C), the outer breaker member 30 applies force against the thick book to firmly clamp the book between the inner and outer breaker members 28 and 30. As this occurs, the outer breaker member 30 moves straight forward at the same speed and in the same direction as the inner breaker member 28 and the thick book 32*b*. Thus, the thick book 32*b*, inner breaker member 28 and outer breaker member 30 all move in a direction parallel to the reference line 36 at the same speed indicated by the arrows 54, 56, and 58 in FIG. 3C. The speed, indicated by the arrows 54, 56 and 58, is the same for either a thin book (FIG. 2C) or a thick book (FIG. 3C).

The extended position of the outer breaker member 30, that is, the position at which the outer breaker member 30 engages a book 32*a* or 32*b* (FIGS. 2C and 3C), changes with variations in the thickness of the book. The extended position of the outer breaker member 30 corresponds to the location of the outer side of a book. Since the inner side of the book is aligned with the reference line 36, the location of the outer side of the book varies as a function of variations in the thickness of the book.

The inner breaker member 28 always moves to the same extended position. This is because the inner side of the book is always aligned with the reference line 36. Therefore, when the inner breaker member 28 moves to the extended position in engagement with the inner side of the cover on a book, it is at the reference line 36. The distance which the inner breaker member 28 moves from the fully retracted position (FIGS. 2A and 3A) to the fully extended position (FIGS. 2B and 3B) is the same for a thick or thin book.

As was previously mentioned, the distance which the outer breaker member 30 moves from the fully retracted position (FIGS. 2A and 3A) to the fully extended position (FIGS. 2C and 3C) varies inversely with the thickness of a book. Thus, the thicker the book, the further the fully extended position of the outer breaker member 30 is from the reference line 36 (FIGS. 2C and 3C) and the closer the fully extended position of the outer breaker member is to the fully retracted position of the outer breaker member.

Once the outer breaker member 30 and inner breaker member 28 have engaged a thick book **32*b*, in the manner shown in FIG. 3C, they move with the book at the same speed. The outer breaker member 30 then begins to move away from the book 32*b* while the inner breaker member 28 is still in engagement with the book FIG. 3E). However, with a thick book 32*b*, the outer breaker member moves away from the book later in the operating cycle than with a thin book 32*a* (FIGS. 2D and 3D). Thus, at a time in the operating cycle after the outer breaker member 30 has moved away from the thin book 32*a* (FIG. 2D), the outer breaker member will begin to move away from a thick book 32*b***.

As the outer breaker member 30 moves away from the thick book **32*b* (FIG. 3E), the outer breaker member drive assembly 42 moves the outer breaker member along the same arcuate path 48 as the outer breaker member moves away from the thin book 32*a*. When the outer breaker member 30 has started to move along the arcuate path 48, at a time in the operating cycle which varies as a function of book thickness, the position of the outer breaker member relative to the reference line 36 is the same at the same time in the operating cycle. Thus, the outer breaker member 30 is the same distance from the reference line 36 in FIG. 2E as in FIG. 3E. However, the outer breaker member 30 is further from the thin book 32*a* than from the thick book 32*b*** at the time in the operating cycle represented by FIGS. 2E and 3E.

After the outer breaker member 30 has started to move away from the thick book **32*b* (FIG. 3E), the inner breaker member 28 begins to move away from the thick book along the arcuate path 46 (FIG. 3F). The time in the operating cycle at which the inner breaker member 28 starts to move away from the thick book 32*b* is the same as the time when the inner breaker member starts to move away from the thin book 32*a***.

Whether the book is thick or thin the outer breaker member 30 moves away from the book before inner breaker member 28 starts to move away from the book. The inner and outer breaker members 28 and 30 reach their retracted positions (FIGS. 2A and 3A) at the same time in an operating cycle regardless of whether a thin book **32*a* or a thick book 32*b* is being processed. The retracted position of the inner and outer breaker members 28 and 30** remains constant and does not vary with the thickness of the book.

During the processing of thin and thick books, the inner breaker member is in its extended position (FIGS. 2B and 3B through FIGS. 2E and 3E) for the same extent of an operating cycle of the cover breaker assembly 20. Thus, in one specific embodiment of the invention, the inner breaker member 28 was in engagement with the thin book **32*a* and the thick book 32*b* for approximately 40° of operation of the inner breaker member drive assembly 40**.

The outer breaker member 30 is in engagement with the outer side of the thick book **32*b* for a length of time which is less than the length of time which the inner breaker member 28 engages the inner side of the book. Thus, it is only after the inner breaker member 28 has been moved from its retracted position to its extended position (FIGS. 2B and 3B) that the outer breaker member 30 moves into engagement with a book. The inner breaker member 28 begins to move from its extended position (FIGS. 3E and 3F) toward its retracted position only after the outer breaker member 30** has moved from its extended position (FIG. 3E).

The force which is applied against a thin book **32*a* and a thick book 32*b* by the inner and outer breaker members 28 and 30 is functionally, if not precisely, the same. Thus, from a functional operational standpoint, the same clamping force is applied to opposite sides of the cover adjacent to the backbone of the book by the inner and outer breaker members 28 and 30 independently of the thickness of the book. Once the inner breaker member 28 and outer breaker member 30 have moved into engagement with a book, the clamping force applied against the book by the inner and outer breaker members remains functionally, if not precisely, constant until the outer breaker member 30** starts to move away from the book.

By having the inner breaker member 28 move into and out of engagement with a book at the same time in an operating cycle, the outer breaker member 30 can be moved into engagement with the outer side of the book and out of engagement with the outer side of the book while the inner breaker member 28 is in engagement with the inner side of the book. The outer breaker member drive assembly 42 is constructed in such a manner as to enable the outer breaker member 30 to move into engagement with the outer side of a book at any time within a limited range of movement of the book along the reference line 36. In addition, the outer breaker member drive assembly 42 is constructed in such a manner as to enable the outer breaker member 30 to move out of engagement with the outer side of a book at any time within a limited range of movement of the book along the reference line 36. This enables the inner and outer breaker members 28 and 30 to be used to sequentially process books having different thicknesses without actuation of the thickness adjustment assembly 62. The foregoing description of the cover breaker assembly 20 assumes that thin books **32*a* and thick books 32*b* will be sequentially processed by the cover breaker assembly. However, the cover breaker assembly 20 can be used to sequentially process books having the same thickness. Thus, the cover breaker assembly 20 could be used to process a series of only thin books 32*a* or only thick books 32*b*. By being able to process books of any thickness in a range of thicknesses, the versatility of the cover breaker assembly 20** is enhanced.

Cover Breaker Assembly

When the inner breaker member 28 is in the extended position of FIGS. 2C, 3C, 4 and 8), a straight longitudinally extending edge portion 66 (FIGS. 4 and 8) of the inner breaker member 28 and a straight longitudinally extending portion 68 of the outer breaker member 30 are disposed over the book carriage 24. Once the thickness adjustment assembly 62 (FIG. 1) has been actuated to provide for a desired range of thicknesses, the location of the edge portion 66 of the inner breaker member 28 relative to the book carriage 24 is the same whenever the inner breaker member 28 is in its extended position. However, the location of the extended position of the edge portion 68 (FIGS. 4 and 8) of the outer breaker member 30 relative to the book carriage 24 varies depending upon the thickness of a book 32 to be processed.

Regardless of the thickness of the book 32 to be processed, the longitudinally extending edge portions 66 and 68 on the inner and outer breaker members 28 and 30 remain parallel to each other at all times.

Figure 4:
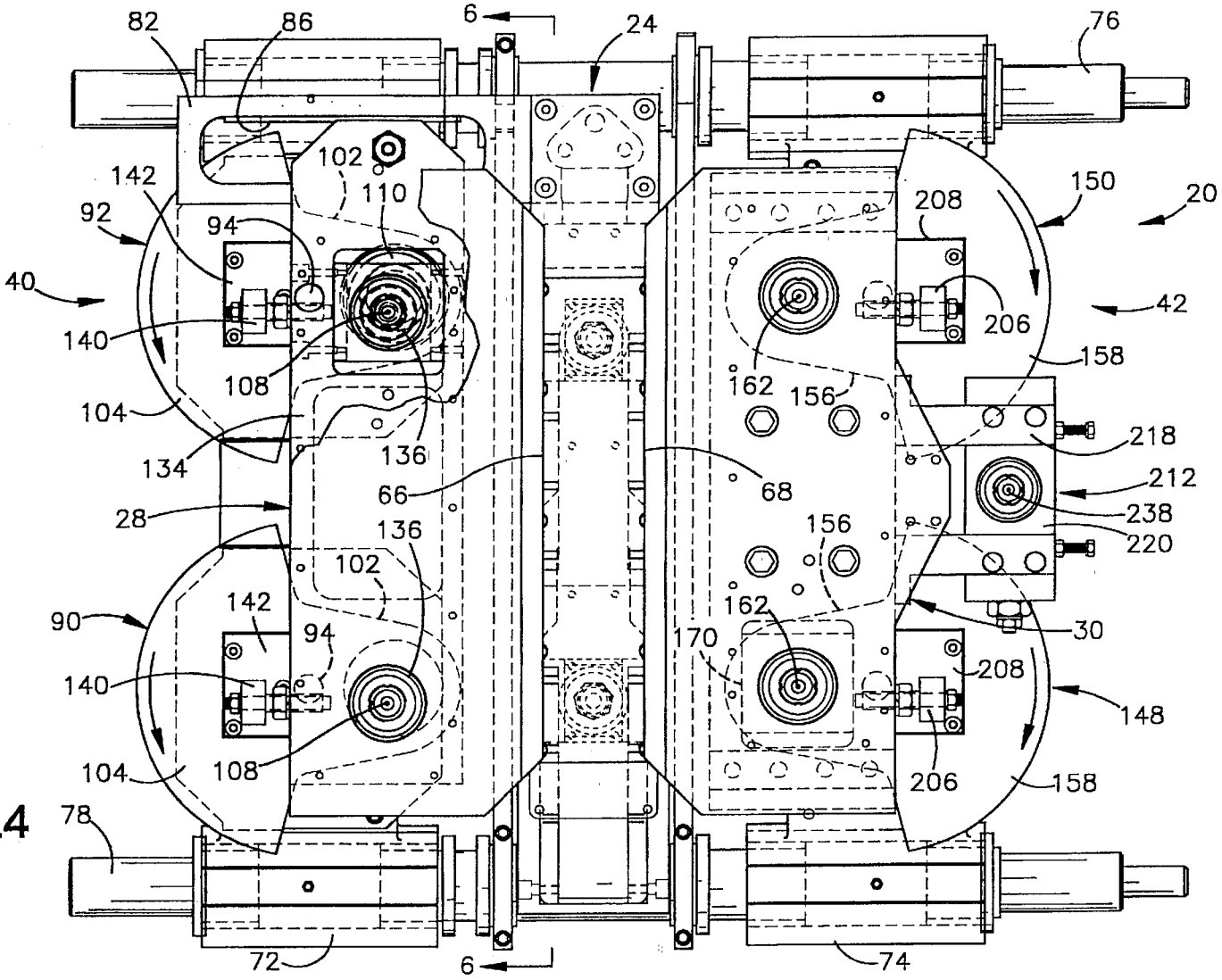
FIG. 4 is a top plan view of the cover breaker assembly of FIG. 1, with inner and outer wings or breaker members in extended positions.
Figure 5:
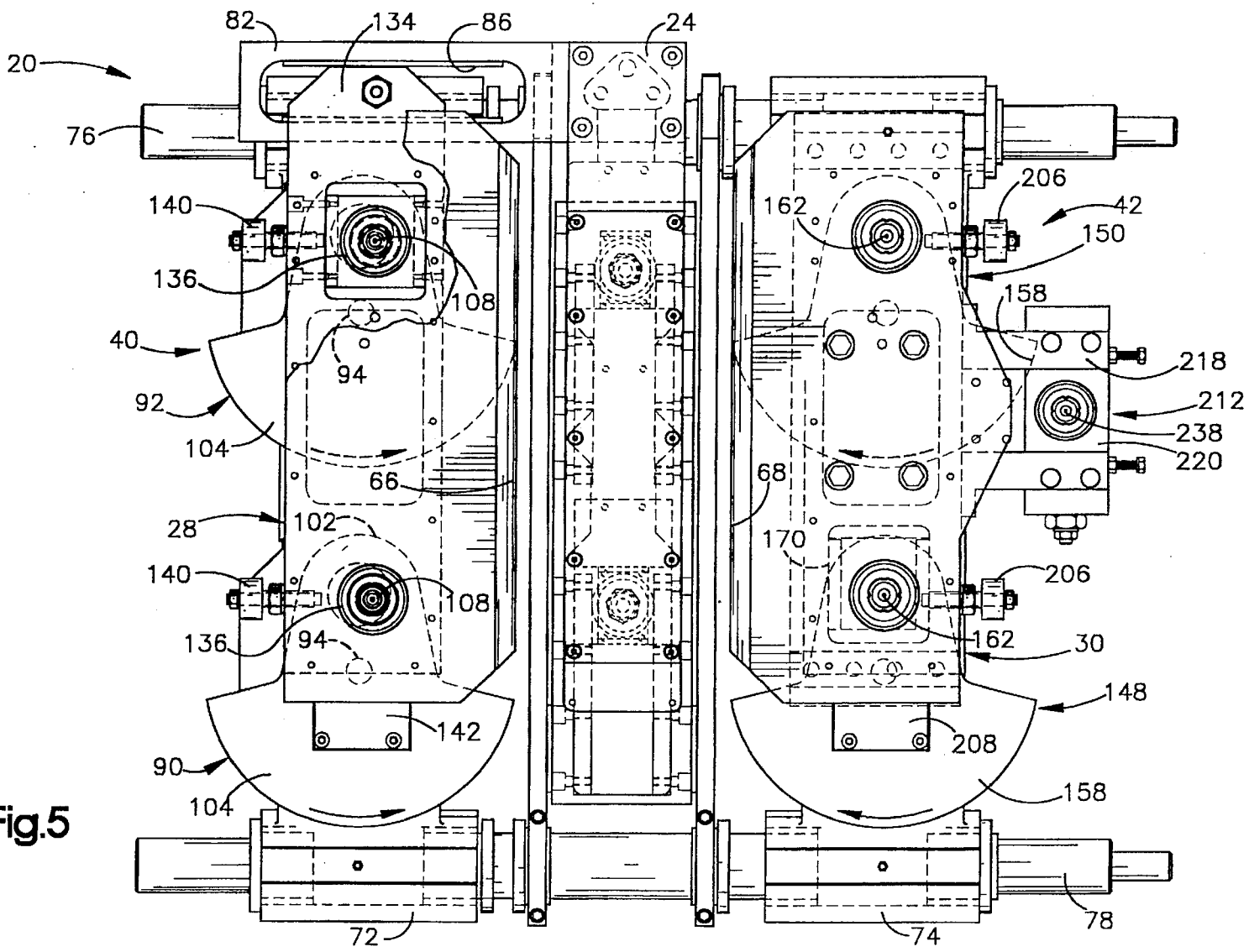
FIG. 5 is a top plan view, generally similar to FIG. 4, illustrating the inner and outer breaker members in a partially retracted condition as the breaker members are moving toward their fully retracted positions.

The longitudinally extending edge portions 66 and 68 of the continuously moving inner and outer breaker members 28 and 30 move away from the book carriage 24 as the inner and outer breaker members are moved from the fully extended positions shown in FIG. 4 toward partially retracted positions shown in FIG. 5. When the inner and outer breaker members 28 and 30 are in the partially retracted positions shown in FIG. 5, the inner and outer breaker members are being moved in opposite directions and at the same angular speed toward their fully retracted positions. At this time, the longitudinally extending edge portions 66 and 68 of the inner and outer breaker members 28 and 30 have moved clear of opposite sides of the book carriage 24 and are both disengaged from the side surfaces of a book (not shown) on the book carriage.

When the outer breaker member 30 initially begins to move from its extended position, the inner breaker member 28 remains in its extended position. It should be understood that although the inner breaker member 28 remains in its extended position, the inner breaker member is moving forward with the book 32 and the book carriage 24 in the manner indicated schematically by the arrows 56 in FIGS. 3B–3E.

Once the inner breaker member 28 starts to move away from the extended position of FIG. 4 toward the partially retracted position of FIG. 5, the inner and outer breaker members move along the arcuate paths 46 and 48 (FIG. 3F) at the same speed and in opposite directions, that is away from each other. After the inner breaker member 28 begins to move away from its extended position, the distance from the longitudinally extending inner edge 66 of the inner breaker member 28 to the book carriage 24 is the same as the distance from the longitudinally extending edge 68 of the outer breaker member 30 to the book carriage 24. 0f course, as the inner and outer breaker members 28 and 30 move away from their extended positions towards their retracted positions, the distance between the parallel longitudinal edges 66 and 68 of the inner and outer breaker members 28 and 30 increases.

The inner and outer breaker members 28 and 30 both move along a continuous path between their extended and retracted positions without stopping. The continuous paths along which the inner and outer breaker members 28 and 30 move include parallel linear segments along which the inner and outer breaker members 28 and 30 move when they are in their extended positions. The length of the linear segment of the continuous path along which the inner breaker member 28 moves remains constant with variations in the thickness of the book being processed. The length of the linear segment of the continuous path along which the outer breaker member 30 is moved varies as a direct function of the thickness of the book being processed.

If a book 32 being processed is thin, the linear segment of the continuous path along which the outer breaker member 30 is moved is short. If the book being processed is thick, the length of the linear segment of a continuous path along which the outer breaker member 30 moves is long. However, the length of the linear segment of a continuous path along which the outer breaker member 30 continuously moves is always shorter than the length of the linear segment of the continuous path along which the inner breaker member 28 continuously moves.

The inner and outer breaker members 28 and 30 move along arcuate segments of their continuous paths when the breaker members are being moved toward and away from their extended positions. Thus, as the breaker members 28 and 30 move away from their extended positions, they are moved along arcuate paths to a retracted position in which the inner and outer breaker members 28 and 30 are spaced a maximum distance from the book carriage 24 and the reference line 36. Movement of the inner and outer breaker members 28 and 30 is then continued along the arcuate path from the retracted positions back to their extended positions. The arcuate segments of the continuous paths along which the inner and outer breaker members 28 and 30 are moved form portions of a circle having a chord which is the linear segment of the continuous path.

The inner breaker member 28 moves in a continuous manner. Thus, the inner breaker member 28 moves from its extended position along the arcuate segment of its continuous path, through the retracted position of the inner breaker member, and back to the extended position of the inner breaker member without stopping. The inner breaker member 28 then moves straight forwardly, that is upwardly (as viewed in FIG. 4) along the linear segment of the continuous path. Thus, motion of the inner breaker member is never interrupted. The inner breaker member 28 is continuously in motion along either the arcuate segment or the linear segment of a continuous path.

The outer breaker member 30 is moved away from the extended position of FIG. 4 toward the retracted position along the arcuate segment of the continuous path. The continuous movement of the outer breaker member 30 continues through the retracted position back to the extended position. The continuous movement of the outer breaker member 30 then continues along the linear portion of the continuous path. The motion of the outer breaker member 30 is never interrupted. The outer breaker member 30 is continuously in motion along either the arcuate segment or the linear segment of a continuous path.

The extent of the arcuate segment of the continuous path along which the outer breaker member 30 moves will vary depending upon the thickness of the book 32 being processed. If a book is thick, the arcuate segment of the continuous path will be short and the linear segment will be long. However, if the book is thin, the length of the arcuate segment will be long and the length of the linear segment will be short. Regardless of the extent of the arcuate and linear segments, the outer breaker member 30 is continuously in motion. Thus, the outer breaker member is either moving upwardly (as viewed in FIGS. 4 and 5) along the linear segment of the continuous path or is moving along the arcuate portion of the continuous path toward or away from the extended position.

Figure 1:
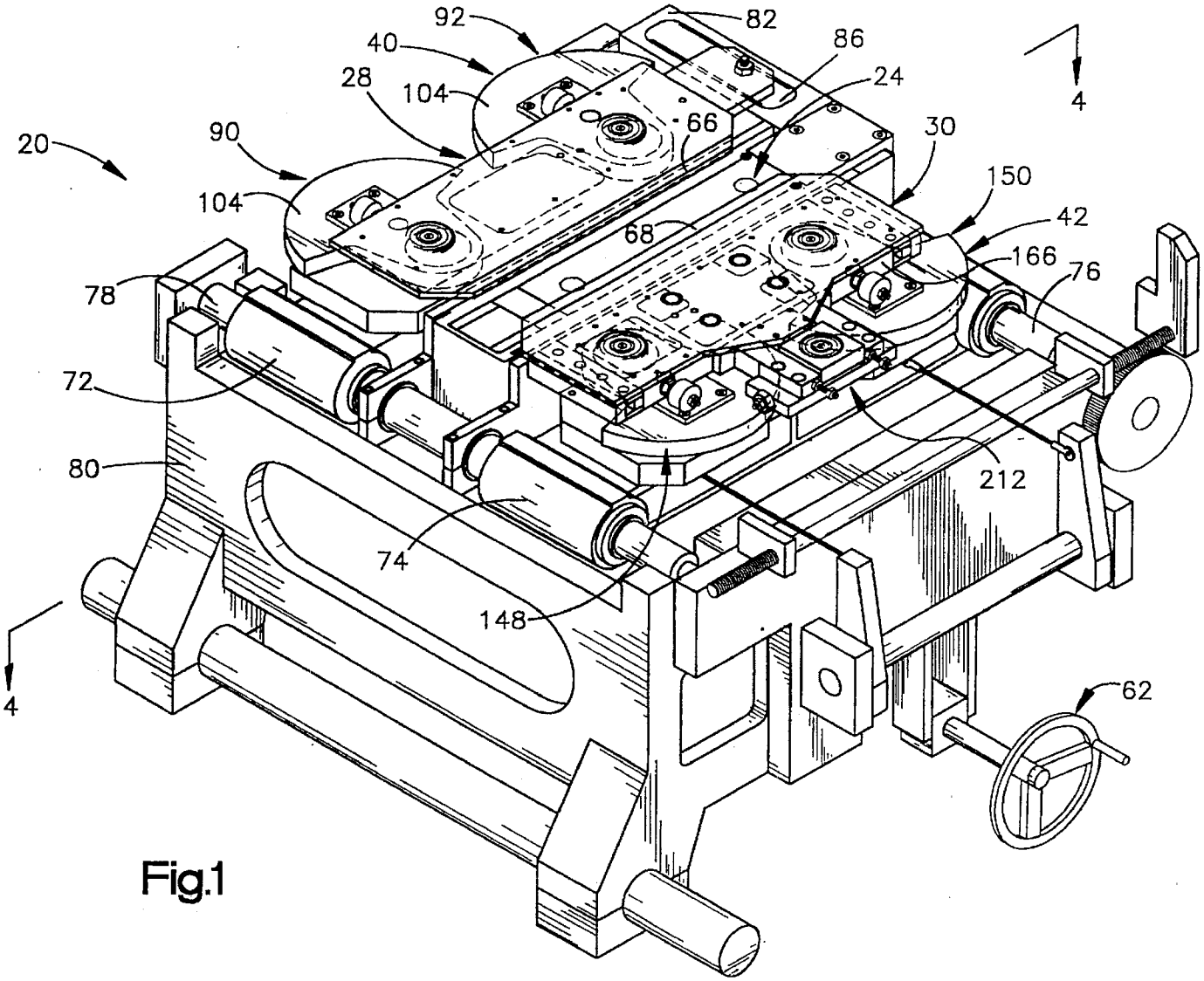
FIG. 1 is a simplified pictorial illustration of a cover breaker assembly which is constructed and operated in accordance with the present invention.

The inner breaker member 28 is supported on an inner breaker member carriage 72 (FIGS. 4 and 5). Similarly, the outer breaker member 30 is supported on an outer breaker member carriage 74. The carriages 72 and 74 are supported for movement along parallel shafts or slide rods 76 and 78 fixedly mounted on a base 80 (FIG. 1). The inner breaker member carriage 72 is movable along the slide rods 76 and 78 relative to the base 80, to adjust the position of the inner breaker member 28 relative to the reference line 36 (FIGS. 2 and 3). The outer breaker member carriage 74 is movable relative to the base 80, along the rods 76 and 78 by the thickness adjustment assembly 62 (FIG. 1), to adjust for desired range of thickness of books.

In accordance with one of the features of the invention, the position of the outer breaker member carriage 74 is adjusted to enable books of different thicknesses to be sequentially processed by the cover breaker assembly 20 without further adjusting of the position of the outer breaker member carriage. Thus, the thickness adjustment assembly 62 is actuated to move the outer breaker member carriage 74 to a position in which books having a thickness within a desired range of thicknesses can be processed. The thickness adjustment assembly 62 is not actuated again during the sequential processing of books of different thicknesses in the range of thicknesses.

The book carriage 24 is connected with the inner breaker member 28 for movement therewith. The book carriage 24 is continuously reciprocated along a linear path during operation of the cover breaker assembly 20. In addition, the book carriage 24 is raised as it is moved in a forward direction, to press the back of the cover against the backbone of the book. A known apparatus is used to raise and lower the book carriages as it is reciprocated.

Figure 9:
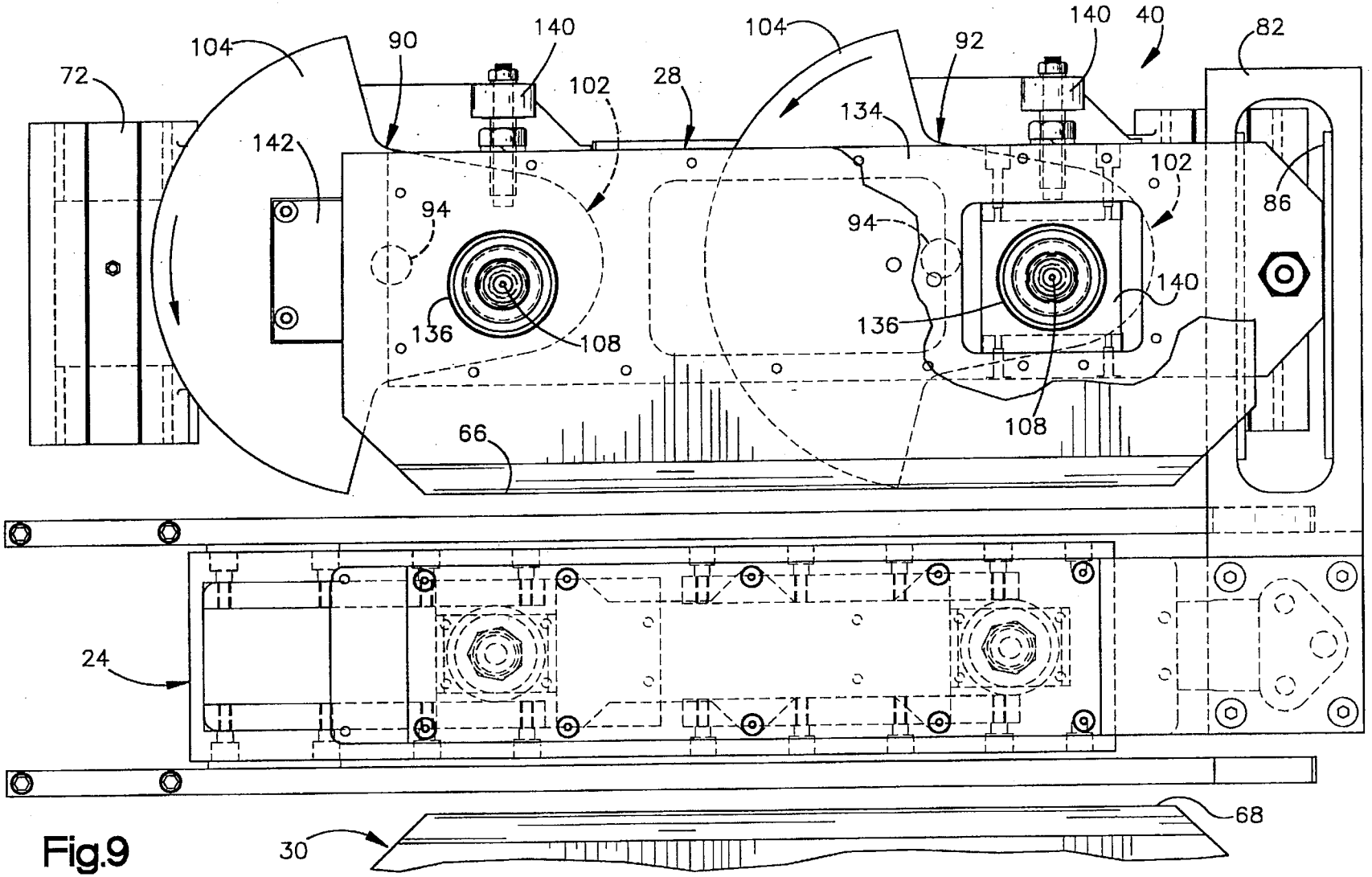
FIG. 9 is a plan view, generally similar to FIG. 7, of the inner breaker assembly and depicting the relationship of the inner breaker assembly to a book carriage.

The book carriage 24 is connected with the inner breaker member drive assembly by a drive bar 82 (FIGS. 4, 5 and 9). The inner breaker member drive assembly 40 is connected with the drive bar 82 by a roller 84 (FIG. 6) which extends into a linear slot 86 (FIG. 4) in the drive bar. During movement of the inner breaker member 28 along its continuous path, the book carriage 24 is only reciprocated in a direction parallel to the reference line 36. During movement of the inner breaker member 28 along the arcuate portion of its continuous path, the roller 84 moves along the slot 86 and is ineffective to move the book carriage 24 sidewardly. However, as the inner breaker member 28 moves along the arcuate portion of its continuous path, the roller 84 does transmit force to the drive bar 82 to move the book carriage 24 along its linear path.

Inner Breaker Member Drive Assembly and Breaker Member

Figure 6:
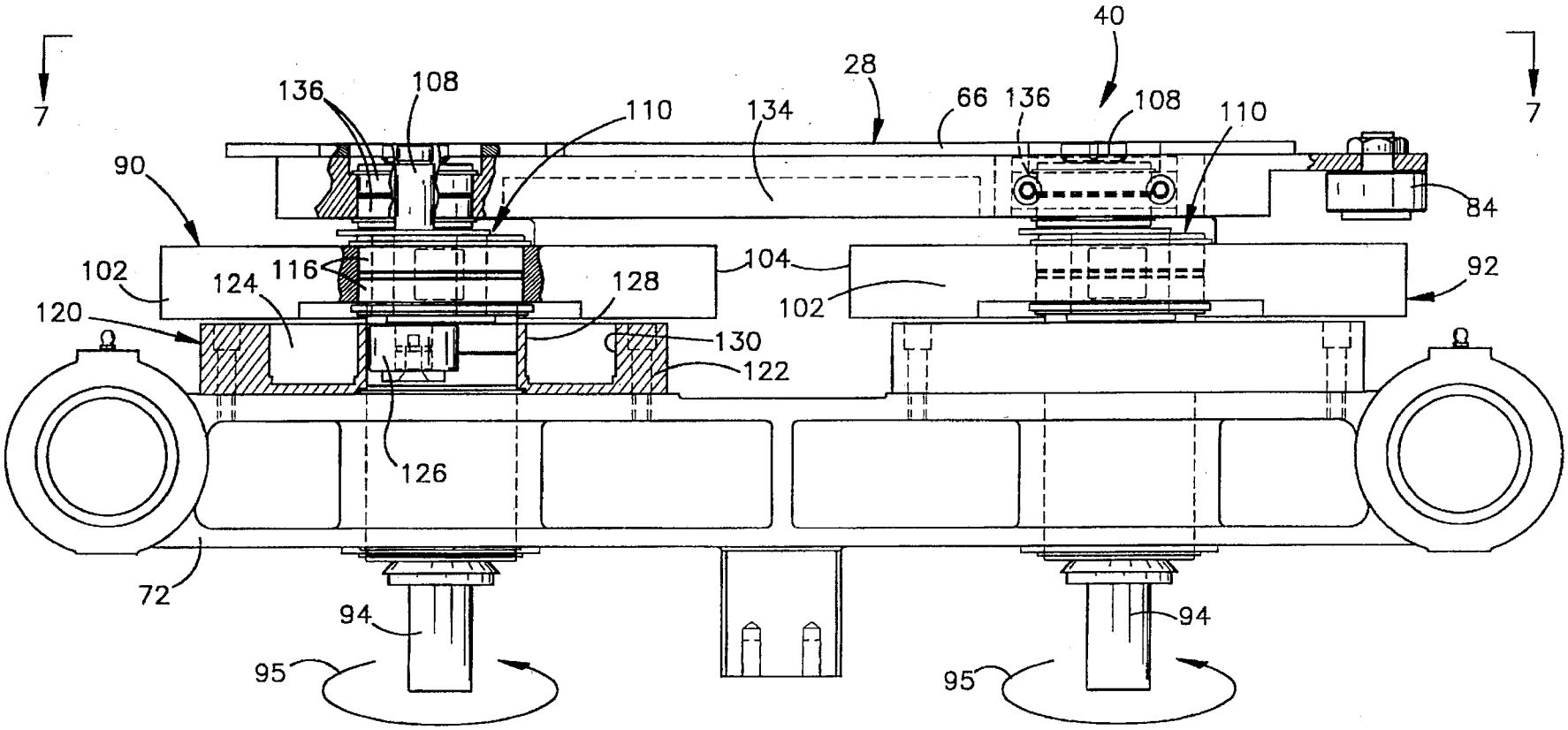
FIG. 6 is a side elevational view, taken generally along the line 6—6 of FIG. 4, illustrating a portion of an inner breaker assembly.
Figure 7:
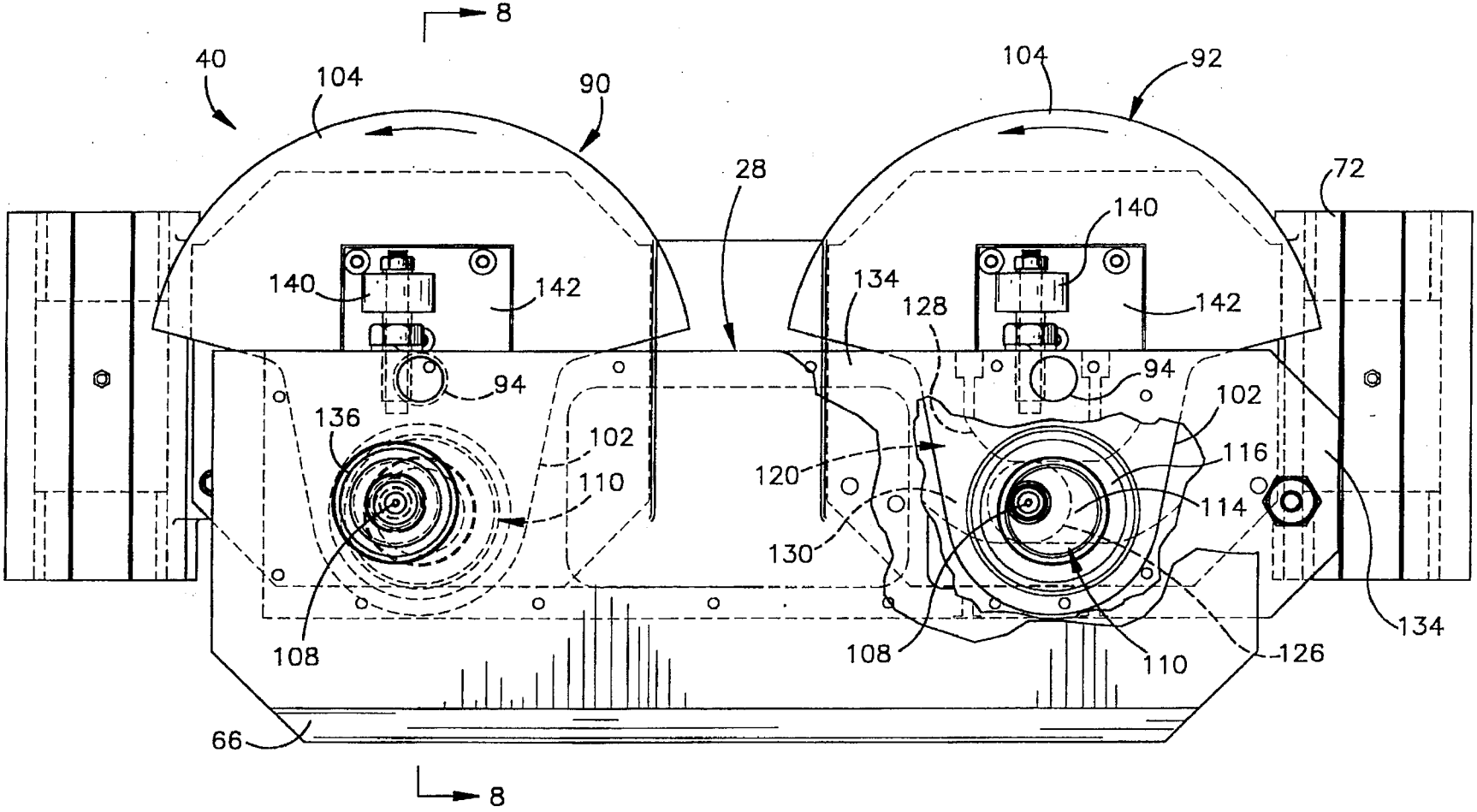
FIG. 7 is a partially broken away plan view taken generally along the line 7—7 of FIG. 6, further illustrating the construction of the inner breaker assembly.
Figure 8:
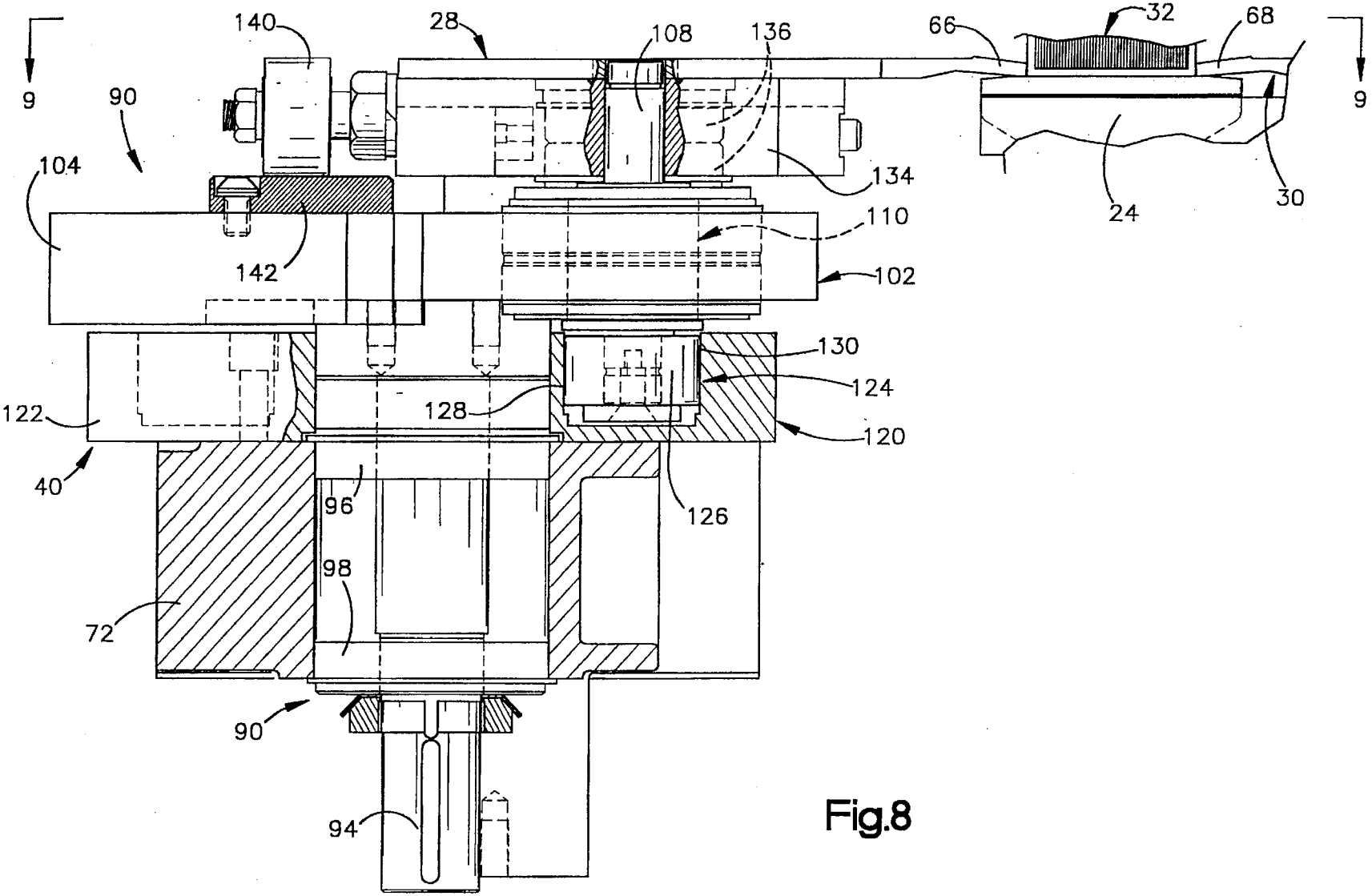
FIG. 8 is a fragmentary sectional view, taken generally along the line 8—8 of FIG. 7, further illustrating the construction of the inner breaker assembly.

The inner breaker member drive assembly 40 includes a pair of identical crank assemblies 90 and 92 (FIGS. 6–9). Each of the crank assemblies 90 and 92 includes a vertical crank shaft 94 (FIG. 6). The crank shafts 94 are continuously driven in the direction of the arrows 95 in FIG. 6 at a constant speed by a main bindery drive system. The vertical axes of the crank shafts 94 are disposed in a vertical plane which extends parallel to the edge portion 66 of the inner breaker member 28 (FIGS. 6, 7 and 8).

Each of the crank shafts 94 is supported for rotation relative to the inner breaker member carriage 72 by a pair of bearing assemblies 96 and 98 (FIG. 8). The lower end portion (as viewed in FIG. 8) of the crank shaft 94 is connected with the main bindery drive system. When the inner breaker member carriage 72 is moved along the slide rods or shafts 76 and 78 (FIG. 4), a drive system connecting the crank shafts 94 with the main bindery drive system is adjusted.

Each of the crank assemblies 90 and 92 includes a crank arm 102 (FIG. 7) which is fixedly connected with a crank shaft 94 (FIG. 8). The crank arms 102 include counterweights 104 which are integrally formed as one piece with the crank arm. The counterweights 104 have a configuration corresponding to the configuration of a segment of a circle (FIGS. 7 and 9).

Vertical crank pins 108 (FIGS. 7 and 8) are connected with the crank arms 102 by eccentric assemblies 110 (FIG. 7). The crank pins 108 have vertical central axes (FIGS. 6 and 8) which extend parallel to the vertical central axes of the crank shafts 94. During operation of the inner breaker member drive assembly 40, the crank shafts 94 and crank arms 102 are continuously rotated about the vertical central axes of the crank shafts. This results in the crank pins 108 being continuously moved relative to the inner breaker member carriage 72.

The eccentric assemblies 110 (FIG. 7) interconnect the crank pins 108 and the crank arms 102. The eccentric assemblies 110 allow relative movement to occur between the crank pins 108 and the crank arms 102 during movement of the inner breaker member 28 along the linear segment of its continuous path of movement. Although it is preferred to use the eccentric assemblies 110 to accommodate relative movement between the crank pins 108 and the inner breaker member 28, a different type of connection could be utilized if desired. For example, a linear cross slide system could be used.

The eccentric assembly 110 (FIGS. 7 and 7A) includes a cylindrical member 114 which is rotatedly supported in a cylindrical opening in the crank arm 102 by a bearing assembly 116. The opening in the crank arm 102, the bearing assembly 116 and the cylindrical member 114 have coincident vertical central axes which extend parallel to the vertical central axis of the crank shaft 94. The crank pin 108 is fixedly connected to the cylindrical member 114. The crank pin 108 has a vertical central axis which is offset from and extends parallel to the vertical central axis of the cylindrical member 114.

During movement of the inner breaker member 28 along the arcuate segment of its continuous path, the orientation of the cylindrical member 114 relative to the crank arm 102 is such that the crank pin 108 is disposed a maximum distance outwardly from the central axis of the crank shaft 94. As the inner breaker member 28 moves from the arcuate segment of its continuous path along a first portion of the linear segment of the continuous path, the cylindrical member 114 is rotated in a clockwise direction (as viewed in FIGS. 7 and 7A) about its vertical central axis relative to the crank arm 102. When the inner breaker member 28 reaches the fully extended position, the crank pin 108 will have moved inwardly toward the crank shaft 94 to a position in which the spacing between the vertical central axis of the crank shaft 94 and the vertical central axis of the crank pin 108 is a minimum.

As the inner breaker member 28 continues to move along the linear segment of its continuous path, the direction of rotation of the cylindrical member 114 relative to the crank arm 102 is reversed. The cylindrical member rotates in a counterclockwise direction (as viewed in FIGS. 7 and 7A) relative to the crank arm 102. As this occurs, the crank pin 108 moves outwardly away from the vertical central axis of the crank shaft 94.

When the inner breaker member 28 has reached the end of the linear segment of its continuous path of movement, the cylindrical member 114 will have rotated relative to the crank arm 102 to a position in which the crank pin 108 is disposed a maximum distance outwardly from the crank shaft 94. At this time, the crank pin 108 is radially aligned with the central axis of the crank shaft 94 and a horizontal central axis of the crank arm 102. The crank pin 108 remains in this position throughout movement of the inner breaker member 28 along the arcuate segment of its continuous path.

Figure 7A:
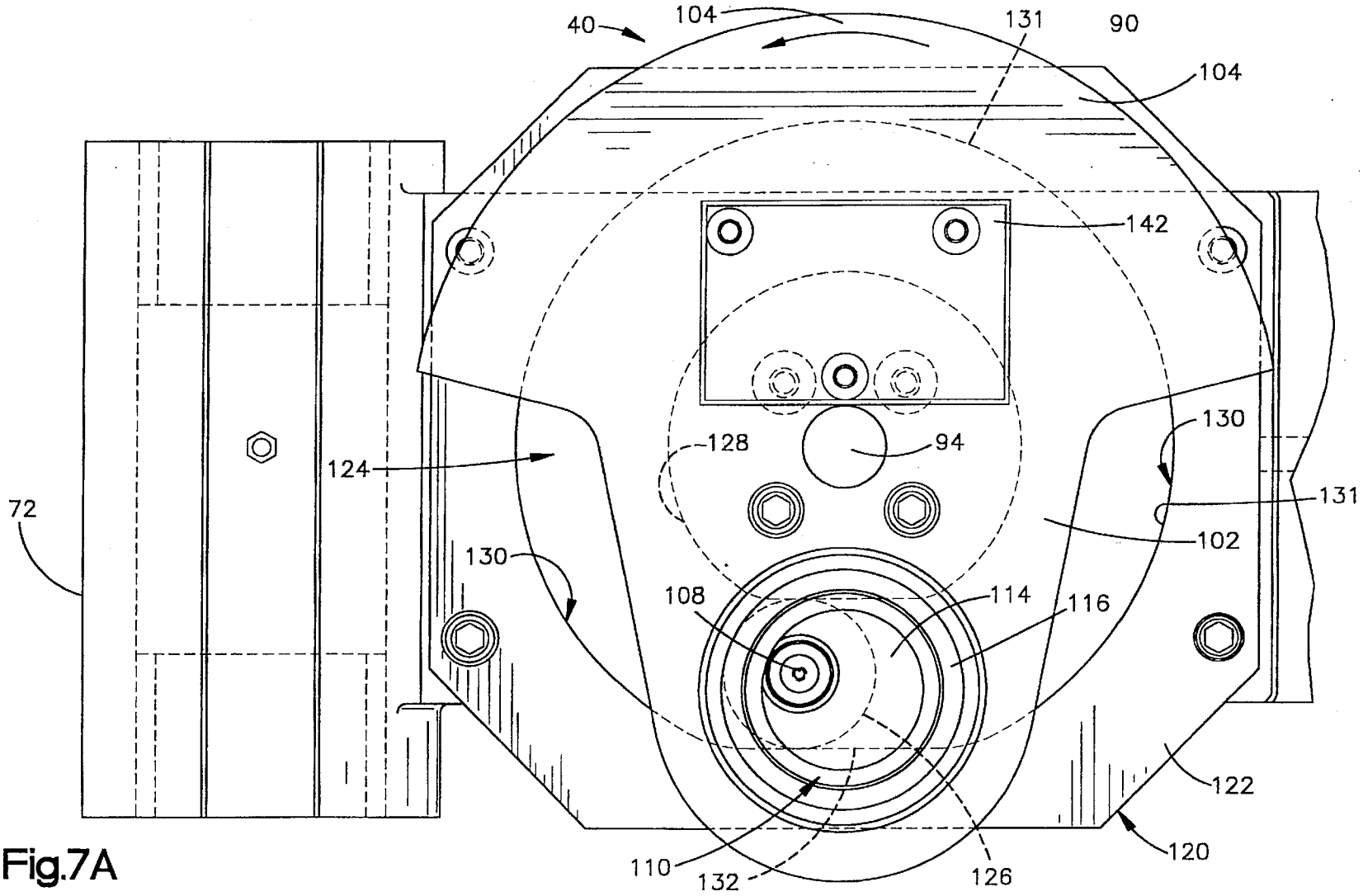
FIG. 7A is an enlarged fragmentary view of a portion of FIG. 7.

A box cam assembly 120 (FIGS. 6, 7, 7A and 8) is provided directly beneath the crank arm 102. The box cam assembly 120 includes a cam block 122 (FIGS. 7*a* and 8). The cam block 122 contains a continuous circuitous cam track 124 (FIGS. 6, 7A and 8) along which a cylindrical cam follower or roller 126 moves. The cam track 124 has a radially inner cam surface 128 and a radially outer cam surface 130 along which the cam follower 126 moves.

The cam follower 126 is connected with a lower end portion of the crank pin 108 (FIGS. 6 and 8). Thus, the vertical crank pin 108 extends through the eccentric assembly 110 and is connected with the cam follower 126. The cam follower 126 is rotatable relative to the crank pin 108 and is disposed in engagement with the inner and outer cam surfaces 128 and 130 (FIGS. 7A and 8). During rotation of the crank arm 102 by the crank shaft 94, the cam follower 126 moves along the cam track 124. Therefore, the position of the crank pin 108 relative to the crank shaft 94 is determined by the configuration of the cam track 124.

The cam track 124 has a constant radius arcuate segment 131 (FIG. 7A) and a linear segment 132 which is connected with opposite ends of the constant radius arcuate segment. In the linear segment 132 of the cam track 124, the inner and outer cam surfaces 128 and 130 are parallel to the edge portion 66 of the inner breaker member 28 and are parallel to a vertical plane extending through the central axes of the crank shafts 94 (FIG. 7). In the arcuate segment 131 of the cam track, the inner and outer cam surfaces 128 and 130 are formed as portions of circles having centers on the central axis of the crank shaft 94.

During movement of the cam follower 126 along the constant radius arcuate segment 131 of the cam track 124, the distance between the central axes of the crank pin 108 and the crank shaft 94 remains constant. However, as the cam follower 126 begins to move along the linear segment of the cam track 124, the cam follower 126 and crank pin 108 are moved inwardly toward the crank shaft 94 until the cam follower 126 reaches the middle of the linear segment 132. The cam track 124 then moves the cam follower 126 radially outwardly away from the crank shaft 94 until the cam follower reaches the end of the linear segment 132 (FIG. 7A) of the cam track 124.

During movement of the cam follower 126 along the linear segment 132 of the cam track 124, the inner breaker member 28 moves along the linear segment of its continuous path. During movement of the cam follower 126 along the constant radius arcuate segment 131 of the cam track 124, the inner breaker member 28 is moved along the arcuate segment of its continuous path.

During movement of the cam follower 126 along the linear segment 132 of the cam track 124, the distance between a vertical plane containing the axes of rotation of the crank shafts 94 and the edge portion 66 of the inner breaker member remains constant. However, the edge portion 66 of the inner breaker member moves along a path extending parallel to the vertical plane containing the axes of rotation of the crank shafts 94. During movement of the cam follower 126 along the arcuate segment 131 of the cam track 124, the distance between the vertical plane containing the axes of rotation of the crank shafts 94 and the edge portion 66 of the inner breaker member 28 decreases as the inner breaker member moves away from a book and then increases as the inner breaker member moves toward the next succeeding book. However, the edge portion 66 of the inner breaker member is always parallel to the vertical plane containing the axes of rotation of the crank shafts 94.

As the cam follower 126 moves into engagement with the linear segment 132 of the cam track 124, the edge portion 66 of the inner breaker member 28 moves into engagement with a cover on a book 32 (FIGS. 2B and 8). The edge portion 66 of the inner breaker member 28 remains in engagement with the book 32 and moves along a linear path with the book in the manner indicated by the arrow 56 in FIGS. 2B through 2E during movement of the cam follower 126 along the linear segment 132 of the cam track 124.

As the cam follower 126 moves from the linear segment 132 of the cam track 124 into engagement with the arcuate segment 131 of the cam track, the inner breaker member 28 begins to move along the arcuate segment of its continuous path, in the manner indicated by the arrow 46 in FIG. 2F. As the cam follower 126 continues to move along the arcuate segment 131 of the cam track 124, the inner breaker member 28 continues to move along the arcuate path 46 through its fully retracted position in which it is a maximum distance from the path of movement of the book carriage 24, back toward the path of movement of the book carriage (FIG. 2A). As the inner breaker member 28 moves into engagement with the next succeeding book (FIG. 2B), the cam follower 126 moves into engagement with the linear segment of the cam track 124.

It is only after the cam follower 126 has moved into engagement with the linear segment 132 of the cam track 124 that the outer breaker member 30 moves into engagement with the cover of a book (FIGS. 2C and 8). Thus, the longitudinally extending edge portion 66 of the inner breaker member 28 is moved into engagement with the book 32 and the cam follower 126 is moving along the linear segment 132 of the cam track 124 before the longitudinally extending edge portion 68 of the outer breaker member 30 moves into engagement with the opposite side of the book (FIGS. 2B and 2C).

The cam track 124 is fixedly secured to the inner breaker member carriage 72. The cam follower 126 moves into engagement with the linear segment 132 of the cam track 124 at the same time in each operating cycle of the cover breaker assembly 20. Once the cam follower 126 has engaged the linear segment 132 of the cam track 124, the inner breaker member 28 is moved forward, that is, in the direction of the arrows 54 and 56 in FIGS. 2B–2E, at substantially, if not precisely, the same speed as the book 32 (FIG. 8).

An inner breaker member carrier frame 134 is connected with the crank pins 108 by bearing assemblies 136 (FIGS. 6–9). The bearing assemblies 136 allow the crank pins 108 to freely rotate relative to the inner breaker member carrier frame 134. However, the bearing assemblies 136 hold the crank pin 108 against radial or sidewise movement relative to the inner breaker member carrier frame 134. Since the distance between the crank pins 108 in the crank assemblies 90 and 92 may vary, due to an accumulation of working tolerances, the bearings 136 for the crank pin 108 in the crank assembly 92 are connected with the inner breaker member carrier frame 134 by a slide member 140 (FIG. 9). The slide member 140 allows the distance between the crank pins 108 in the crank assemblies 90 and 92 to vary somewhat during rotation of the crank arms 102.

The inner breaker member 28 is fixedly secured to and moves with the inner breaker member carrier frame 134. The book carriage drive roller 84 (FIG. 6) is connected to one end portion of the inner breaker member carrier frame 134. The book carriage drive roller 84 is disposed in the slot 86 in the drive bar 82. The drive bar 82 is secured to the book carriage 24. This enables force to be transmitted from the inner breaker member carrier frame 134 to the book carriage 24 through the drive bar 82 (FIGS. 4 and 5) during rotation of the crank assemblies 90 and 92. Support rollers **140*a* (FIGS. 7 and 8) are connected with the inner breaker member carrier frame 134. When the inner breaker member 28 is applying force against the book 32, in the manner illustrated in FIG. 8, the rollers 140*a* engage roller plates 142 on the counterweights 104 (FIG. 7). The rollers 140*a* support the inner breaker member carrier frame 134 and the inner breaker member 28 against counterclockwise (as viewed in FIG. 8) moments applied to the inner breaker member 28**.

Outer Breaker Member Drive Assembly and Breaker Member

The outer breaker member drive assembly 42 (FIG. 4) moves the outer breaker member 30 into engagement with a book 32 (FIG. 8) after the inner breaker member 28 has engaged the book (FIGS. 2B and 2C). Throughout movement of the outer breaker member 30 by the outer breaker member drive assembly 42, the longitudinally extending edge portion 68 (FIG. 4) of the outer breaker member is maintained parallel to the longitudinally extending edge portion 66 of the inner breaker member 28 and to reference line 36.

The inner breaker member drive assembly 40 and the outer breaker member drive assembly 42 are driven at the same angular speed by the main bindery drive system. However, the inner breaker member 28 moves faster than the outer breaker member 30 during movement of the cam follower 126 (FIG. 7A) along the constant radius arcuate segment 131 of the cam track 134. This is because the arcuate segment 131 of the cam track 134 moves the crank pin 108 outwardly from the crank shaft 94 to increase the effective radius of the path along which the crank pin moves. The inner breaker member 28 and the outer breaker member 30 both begin to move from their fully retracted positions toward their extended positions at the same time and at the same angular speed. However, the inner breaker member 28 always engages a book 32 ahead of the outer breaker member 30 due to the cooperation between the cam track 134 and cam follower 126.

Figure 10:
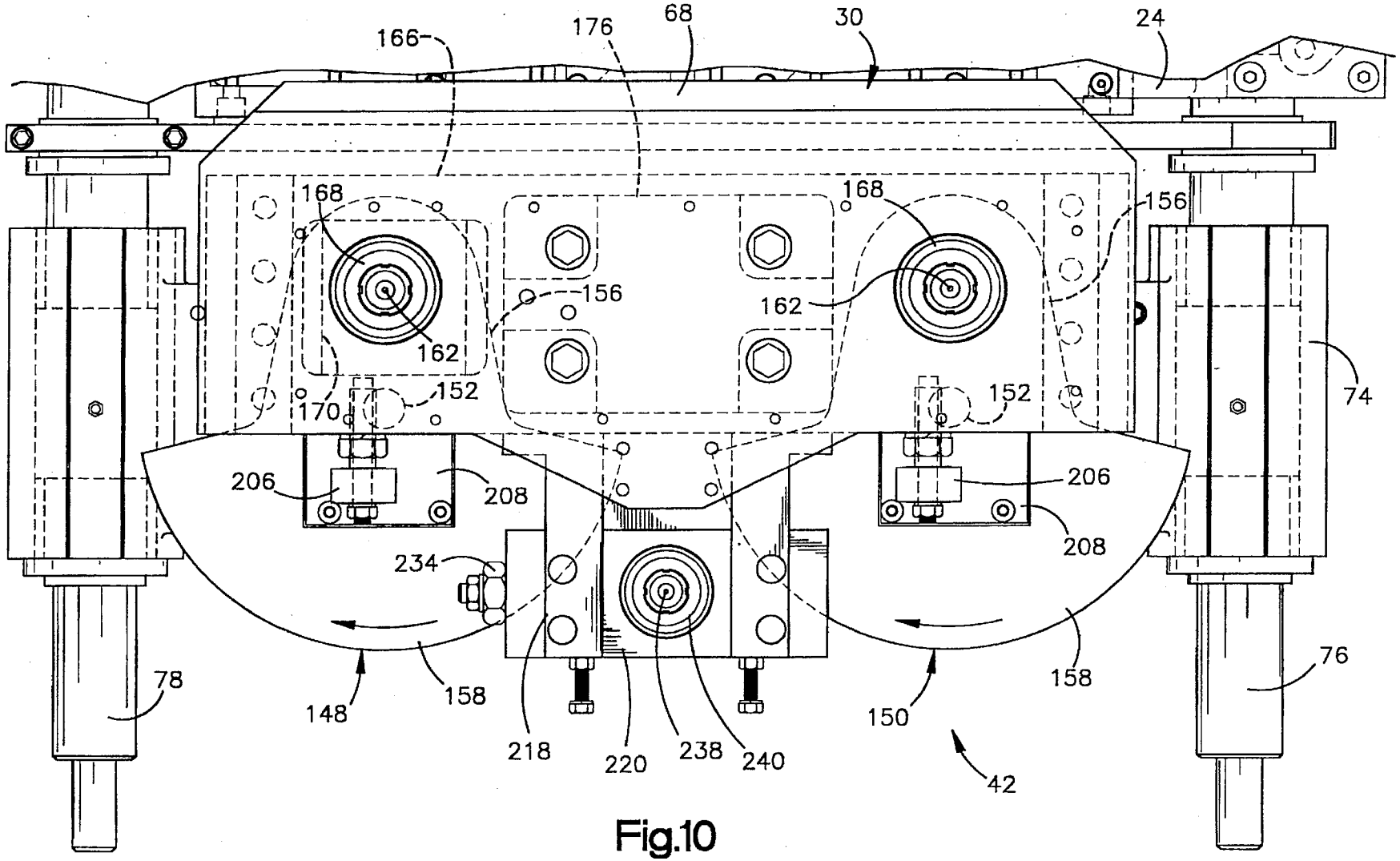
FIG. 10 is an enlarged fragmentary plan view of a portion of FIG. 4 and illustrating the construction of an outer breaker assembly, the outer breaker member being shown in an extended position.
Figure 11:
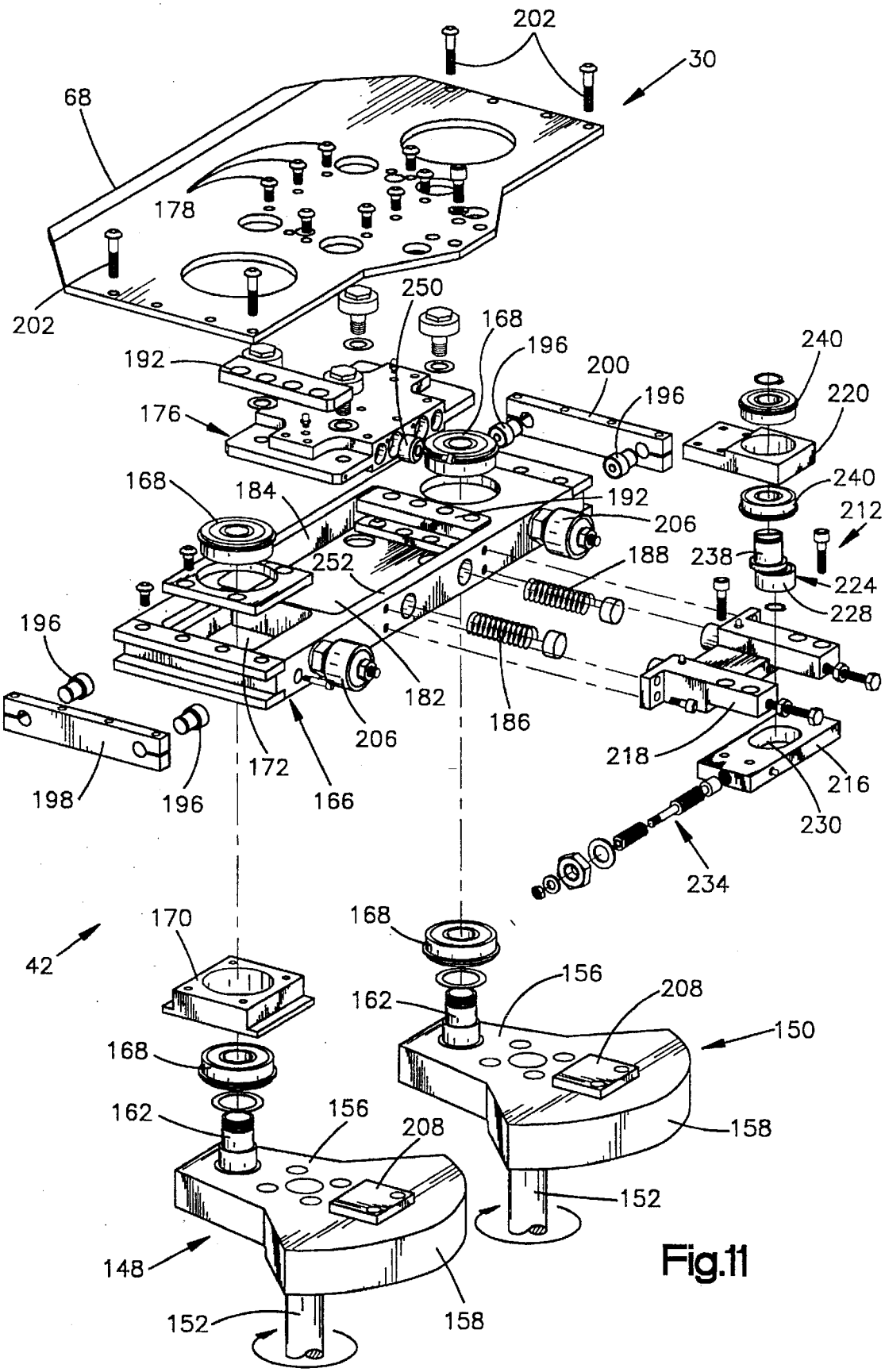
FIG. 11 is an exploded pictorial illustration of components of the outer breaker assembly.
Figure 12:
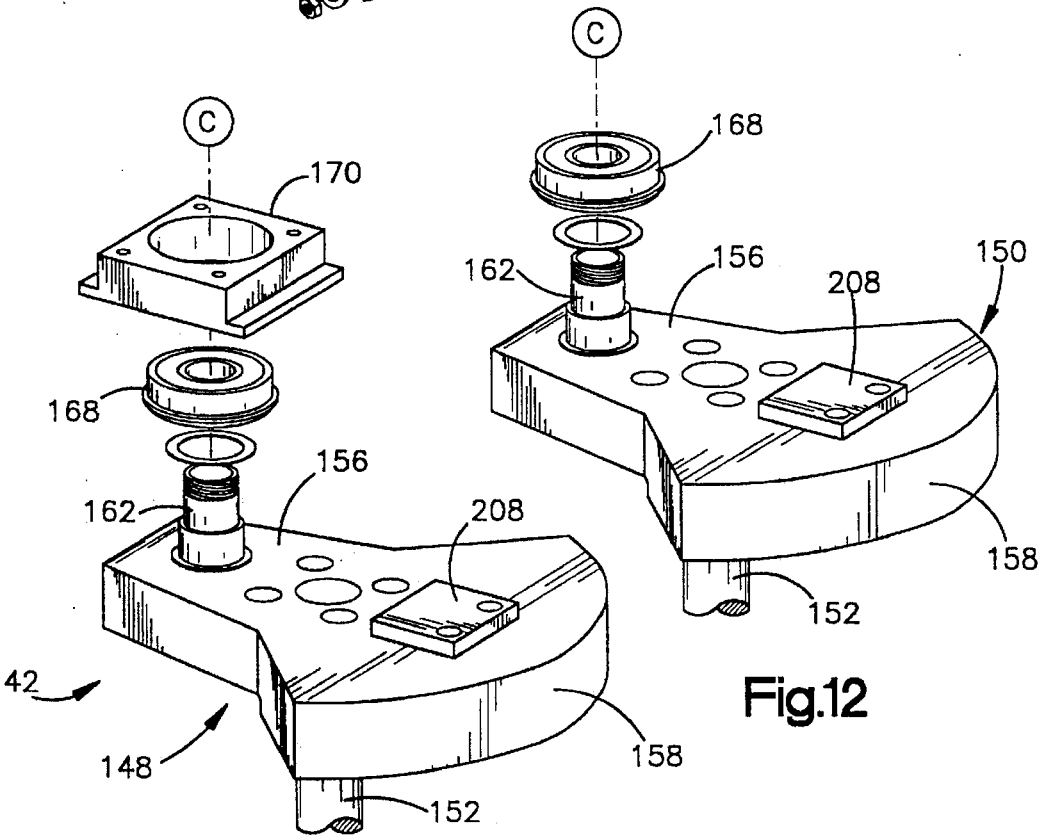
FIG. 12 is an enlarged exploded pictorial illustration of a portion of FIG. 11 and illustrating the construction of crank assemblies used in an outer breaker member drive assembly.

The outer breaker member drive assembly 42 (FIG. 10) includes a pair of crank assemblies 148 and 150 (FIGS. 10, 11, and 12). The crank assemblies 148 and 150 include a pair of vertical crank shafts 152 (FIGS. 11 and 12). The crank shafts 152 are driven by the main bindery drive system. The crank shafts 152 are rotated in a clockwise direction (as viewed in FIGS. 4 and 11) about their vertical central axes by the main bindery system. The crank shafts 94 (FIG. 6) in the inner breaker member drive assembly 40 are driven in a counterclockwise direction (as viewed in FIG. 4).

The crank shafts 152 (FIG. 11) have vertical central axes which are disposed in a vertical plane. The vertical plane containing the axes of the crank shafts 152 extends parallel to the edge portion 68 of the outer breaker member 30. The vertical plane containing the axes of the crank shafts 152 extends parallel to the reference line 36 and the vertical plane containing the vertical axes of rotation of the crank shafts 94 in the inner breaker member drive assembly 40 (FIG. 6).

The distance between the vertical plane containing the axes of the crank shafts 152 and the vertical plane containing the axes of the crank shafts 94 remains constant during the sequential application of covers to thin books **32*a* and thick books 32*b*. The distance between the vertical plane containing the axes of the crank shafts 152 and the vertical plane containing the axes of the crank shafts 94 can only be varied by operation of the thickness adjustment assembly 62. Once the thickness adjustment assembly 62** is set for a desired range of book thickness, the thickness adjustment assembly is not operated during subsequent processing of thick and thin books.

The outer breaker member crank shafts 152 are supported for rotation on the outer breaker member carriage 74 by a plurality of bearing assemblies (not shown). The bearing assemblies cooperate with the crank shafts 152 in the outer breaker member drive assembly 42 in the same manner as in which the bearings 96 and 98 (FIG. 8) cooperate with the crank shafts 94 in the inner breaker member drive assembly 40. The outer breaker member carriage 74, outer breaker member drive assembly 42 and outer breaker member 30 are movable along the slide rods or shafts 76 and 78 to adjust the position of the outer breaker member for a desired range of thicknesses of books 32 to which covers are to be sequentially applied.

Crank arms 156 (FIG. 12) are fixedly connected with the crank shafts 152. Counterweights 158 are integrally formed with the crank arms 156. The crank arms 156 have horizontal central axes which extend radially outwardly from the central axes of the crank shafts 152.

In the outer breaker member drive assembly 42, crank pins 162 (FIG. 12) are fixedly connected to the crank arms 156. The crank pins 162 have parallel vertical axes which extend parallel to the axes of the crank shafts 152. Unlike the crank pins 108 in the inner breaker member drive assembly 40, the crank pins 162 do not move relative to the crank arms 156. Therefore, the distance from the vertical central axes of the crank pins 162 to the vertical central axes of the crank shafts 152 remains constant throughout operation of the outer breaker member drive assembly 42.

The crank pins 162 are connected with an outer breaker member carrier frame 166 (FIG. 11) by bearing assemblies 168. The bearing assemblies 168 for the crank assembly 148 are connected with the a slide 170 (FIG. 11) which is slidably received in a rectangular cavity 172 in the outer breaker member carrier frame 166. The slide member 170 and the bearings 168 for the crank assembly 148 are movable relative to the bearings 168 and crank pin 162 for the crank assembly 150. This movement of the slide 170 accommodates a build up of tolerances in the locations of the crank shafts 152 and the crank pins 162.

In accordance with a feature of the present invention, the outer breaker member 30 is movable relative to the outer breaker member carrier frame 166 when a predetermined force has been applied against a book by the outer breaker member. Thus, the crank assemblies 148 and 150 are driven by the main bindery drive system to move the outer breaker member carrier frame toward a book 32 on the book carriage 24 (FIG. 10). When the longitudinally extending edge portion 68 of the outer breaker member 30 is effective to apply a predetermined force against the side of the book, the outer breaker member 30 moves relative to the outer breaker member carrier frame 166.

When the outer breaker member 30 applies a force against a cover on a relatively thin book **32*a* (FIG. 2C), relatively little movement subsequently occurs between the outer breaker member 30 and outer breaker member carrier frame 166. However, when the outer breaker member 30 applies the same force against a relatively thick book (FIG. 3C), a greater amount of movement subsequently occurs between the outer breaker member 30 and outer breaker member carrier frame 166. This is because the outer breaker member carrier frame 166 is moved along the same continuous circular path when the outer breaker member 30** engages either a thick book or a thin book.

When the outer breaker member 30 is being used to apply a cover to a thin book, the outer breaker member 30 overlaps the book carriage 24 to a relatively large extent when the outer breaker member 30 engages the thin book. However, when the outer breaker member 30 engages a thick book, there is less overlap between the outer breaker member and the book carriage 24. During movement of the outer breaker member 30 relative to the outer breaker member carrier frame 166, the outer breaker member 30 moves in the same direction and at substantially the same speed as the book 32 and the book carriage 24.

Figure 13:
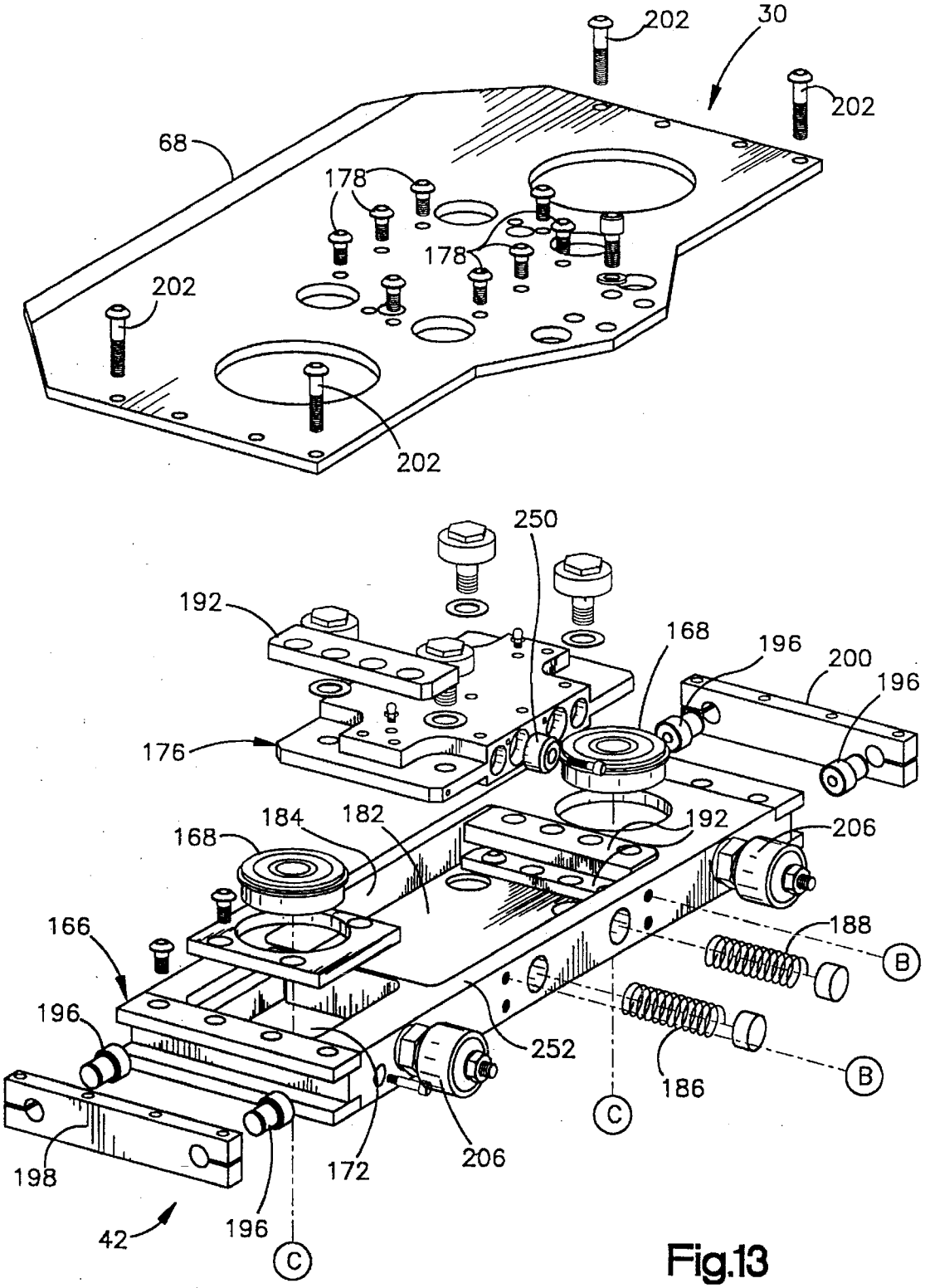
FIG. 13 is an enlarged pictorial illustration of a portion of FIG. 11 and illustrating the relationship of an outer breaker member to a slide and to a carrier frame.

The outer breaker member 30 is fixedly secured to a slide 176 by fasteners 178 (FIG. 13). The slide 176 is disposed in a generally rectangular slide chamber 182 disposed in the outer breaker member carrier frame 166. The slide 176 is movable toward and away from a longitudinally extending front edge portion 184 of the outer breaker member carrier frame 166 and the slide chamber 182. Biasing springs 186 and 188 urge the slide 176 toward the front edge portion of the slide chamber 182.

During operation of the outer breaker member drive assembly 42, the outer breaker member carrier frame 166 is moved toward a book 32 along the along a circular path by the crank assemblies 148 and 150. When the longitudinally extending edge portion 68 of the outer breaker member 30 engages the side of a book 32 and applies sufficient force against the book to overcome the influence of the biasing springs 186 and 188, the slide 176 moves away from the front edge portion 184 of the slide chamber 182. When the outer breaker member 30 engages the book 32, the outer breaker member carrier frame 166 continues to move toward the book along the circular path under the influence of the crank assemblies 148 and 150. This results in the outer breaker member carrier frame 166 moving relative to the slide 176 and outer breaker member 30.

Since the outer breaker member 30 moves relative to the outer breaker member carrier frame 166, the outer breaker member 30 only moves straight forward, in the direction indicated by the arrows 58 in FIGS. 2C and 3C. Thus, the outer breaker member 30 and outer breaker member carrier frame 166 move together toward the book 32 along the arcuate path 48. After the outer breaker member 30 engages the book 32, the component movement of the outer breaker member toward the book is absorbed by movement of the slide 176 relative to the outer breaker member carrier frame 166. The component of movement of the outer breaker member 30 toward the right (as viewed in FIG. 10) has substantially, if not precisely, the same speed and direction as the book carriage 24 and the book 32. Thus, as the slide 176 moves relative to the outer breaker member carrier frame 166, the slide and outer breaker member 30 are both moved forward together along a straight path in the same direction and at the substantially same speed as the book carriage 24.

The distance through which the slide 176 moves relative to the outer breaker member carrier frame 166 varies as a direct function of the thickness of the book engaged by the outer breaker member 30. Thus, if the outer breaker member 30 engages a thin book **32*a* (FIG. 2C), the outer breaker member carrier frame 166 moves through a small distance relative to the slide 176. However, if the outer breaker member 30 engages a thick book 32*b* (FIG. 3C), the outer breaker member carrier frame 166 moves through a larger distance relative to the slide 176**.

The crank assemblies 148 and 150 are secured to the outer breaker member carrier frame 166. Therefore, the outer breaker member carrier frame 166 moves along a segment of a continuous circular path during engagement of the outer breaker member 30 with a thin book and during engagement of the outer breaker member with a thick book. The path along which the outer breaker member carrier frame 166 is moved does not vary with variations in the thickness of the books to which covers are to be applied. However, the path of movement of the outer breaker member 30 and slide 176 varies with variations in the thickness of the books to which covers are to be applied.

When a cover is being applied to a thick book **32*b*, the outer breaker member 30 engages the book early in the cycle of movement of the outer breaker member carrier frame 166 toward the book. Once the outer breaker member 30 engages the book and applies sufficient force against the book to overcome the influence of the biasing springs 186 and 188 (FIG. 11), the slide 176 moves relative to the outer breaker member carrier frame 166 along a linear path. The combination of linear movement of the slide 176 relative to the outer breaker member carrier frame 166 and the movement of the outer breaker member carrier frame along a circular path by the crank assemblies 148 and 150 results in the outer breaker member 30 and slide 176 being moved toward the right (as viewed in FIG. 10) at substantially the same speed and in the same direction as the book and book carriage 24. It should be understood that there may be a negligible difference between the speed of the breaker member 30 and the speed of the book carriage 24**.

During movement of the outer breaker member 30 and slide 176 relative to the outer breaker member carrier frame 166, the edge portion 68 of the outer breaker member 30 is parallel to the vertical plane containing the axes of rotation of the crank shafts 152. As the outer breaker member 30 and slide 176 move relative to the outer breaker member carrier frame 166, the distance between the edge portion 68 of the outer breaker member 30 and the vertical plane containing the axes of rotation of the crank shafts 152 remains constant. However, the edge portion 68 of the outer breaker member 30 moves along a path extending parallel to the vertical plane containing the axes of rotation of the crank shafts 152 at the same speed and in the same direction as the book carriage 24.

Once the edge portion 68 of the outer breaker member 30 has engaged a book disposed between the inner and outer breaker members 28 and 30, the distance between the edge portions 66 and 68 of the inner and outer breaker members remains constant as long as the outer breaker member remains in engagement with the book. The distance between the edge portions 66 and 68 of the breaker members 28 and 30 remains constant at a distance corresponding to the thickness of the book. However, the distance between the front edge portion 184 of the outer breaker member carrier frame 166 and slide 176 varies. Thus, as the crank assemblies 148 and 150 move the outer breaker member carrier frame 166 toward a book with the outer breaker member 30 in engagement with the book,, the biasing springs 186 and 188 are compressed and the distance between the front edge portion 184 of the outer breaker member carrier frame 166 and the slide 176 increases. As the crank assemblies 148 and 150 move the outer breaker member carrier frame 166 away from the book with the outer breaker member 30 in engagement with the book, the biasing springs 186 and 188 are expanded and the distance between the front edge portion 184 of the outer breaker member carrier frame 166 and the slide 176 decreases.

The force applied against a thin book **32*a* by the outer breaker member 30 is substantially the same as the force applied against a thick book 32*b* by the outer breaker member. This is because the force applied against either a thick book or a thin book is determined by the compression of the springs 186 and 188. Of course, compressing the springs 186 and 188 results in the force applied against a thick book 32*b* being slightly greater than the force applied against a thin book 32*a*. Due to the combined effect of precompression of the springs 186 and 188, inertia forces and the 0.1875 inch difference between the thickness of a thick book 32*b* and a thin book 32*a*, the increase in force which results from the greater compression of the springs 186 and 188 by a thick book is considered to be negligible. Once the biasing force of the springs 186 and 188 has been overcome, the slide 176 and outer breaker member 30 move together relative to the outer breaker member carrier frame 166** against influence of the springs.

A plurality of guide members 192 (FIGS. 11 and 13) are provided in the slide chamber 182 to guide movement of the slide 176 relative to the outer breaker member carrier frame 166. It should be understood that although only three guide members 192 are illustrated in FIG. 13, there are four guide members in the slide chamber 182. Thus, a pair of guide members 192 is provided for each of the opposite side edge portions of the slide 176. The central axes of the guide members 192 extend perpendicular to the longitudinally extending edge portion 68 of the outer breaker member 30 and to the path of movement of the book carriage 24.

Movement of the outer breaker member 30 relative to the outer breaker member carrier frame 166 is also guided by rollers 196 which are rotatably mounted on bars 198 and 200 (FIG. 13). The bars 198 and 200 are fixedly secured to opposite edge portions of the outer breaker member 30 by fasteners 202.

During the application of force to a book by the edge portion 68 of the outer breaker member 30 (FIG. 8) moments applied to the outer breaker member 30 and outer breaker member carrier frame 166 tend to tip the outer breaker member carrier frame in a clockwise direction (as viewed in FIGS. 11 and 13). To offset these moments, support rollers 206 connected with the outer breaker member carrier frame 166 engage roller plates 208 on the counterweight portions 158 of the crank arms 156.

Figure 14:
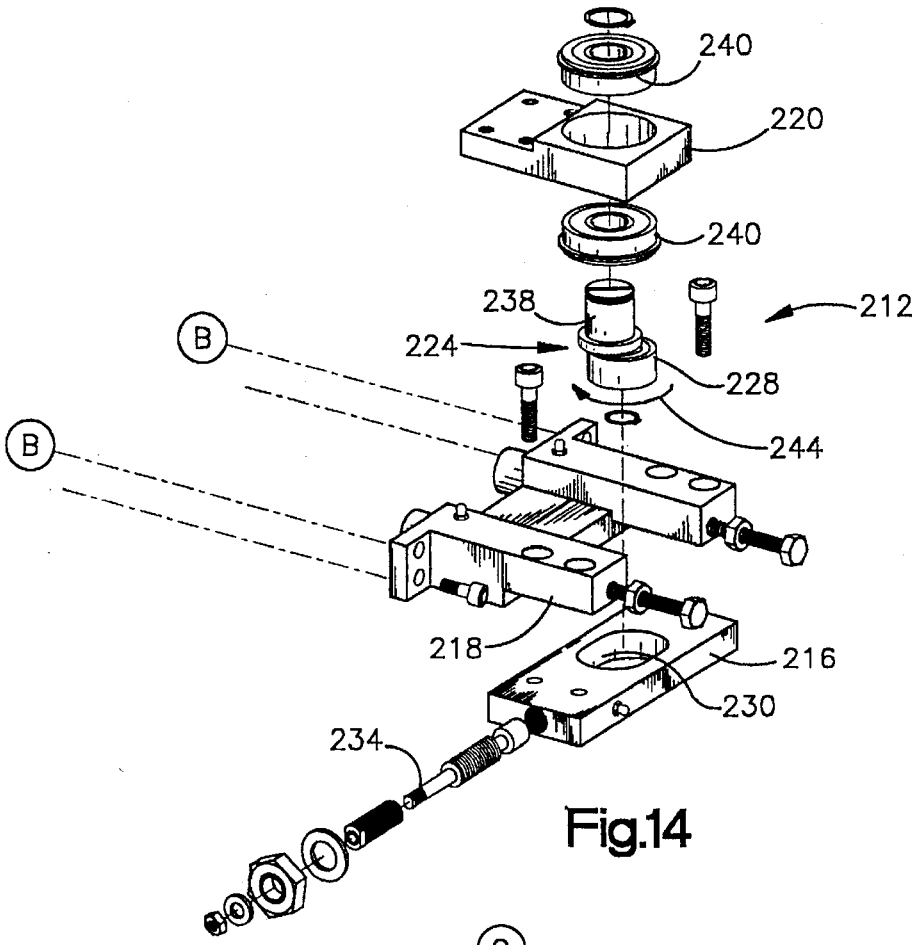
FIG. 14 is an enlarged illustration of a portion of FIG. 11 and illustrating the construction of a slide stop assembly.

The slide 176 and outer breaker member 30 are returned to an initial position relative to the outer breaker member carrier frame 166 by the springs 186 and 188. The location of the initial position of the slide 176 and the outer breaker member 30 relative to the outer breaker member carrier frame 166 is determined by a slide stop assembly 212 (FIGS. 11 and 14). The slide stop assembly 212 includes a stop block 216 which is fixedly secured to the outer breaker member carrier frame 166 by a carrier connector block 218. A slide connector block 220 is fixedly secured to the outer breaker member 30. The outer breaker member 30 is in turn fixedly connected to the slide 176. Therefore, the slide connector block 220 is fixedly secured to the slide 176.

An eccentric assembly 224 interconnects the stop block 216 and the slide connector block 220. The eccentric assembly 224 is operable to enable relative movement to occur between the stop block 216 and the slide connector block 220. This enables relative movement to occur between the slide 176 to which the slide connector block 220 is fixedly connected and the outer breaker member carrier frame 166 to which the stop block 216 is fixedly connected.

The eccentric assembly 224 includes a cylindrical member 228 which is received in a slot 230 formed in the stop block 216. The cylindrical member 228 is rotatable relative to the stop block 216 and is disposed in engagement with parallel opposite side surfaces of the slot 230. The cylindrical member 228 is movable axially along the parallel side surfaces of the slot 230 during relative movement between the outer breaker member carrier frame 166 and the slide 176.

A spring assembly 234 applies force against the circular member 228. The force applied by the spring assembly 234 to the circular member 228 urges the circular member toward an initial position relative to the stop block 216. When the circular member 228 is in its initial position relative to the stop block 216, the slide 176 is in its initial position relative to the outer breaker member carrier frame 166.

A cylindrical crank arm 238 is fixedly connected to the cylindrical member 228 and extends upwardly into bearing assemblies 240 mounted on the slide connector block 220. The crank arm 238 is rotatable relative to the bearing assemblies 240 and the slide connector block 220. A vertical central axis of the crank arm 238 is offset from a vertical central axis of the cylindrical member 228.

Upon the occurrence of movement of the outer breaker member carrier frame 166 forwardly relative to the slide 176 after the outer breaker member 30 has engaged a book, the crank arm 238 rotates in a counterclockwise direction as indicated by an arrow 244 in FIG. 14. Rotation of the crank arm 238 moves the cylindrical body 228 toward the right in the slot 230. As this occurs, the crank arm 238 pivots to enable the outer breaker member 30 and slide 176 to move rearwardly relative to the outer breaker member carrier frame 166 and the stop block 216.

As the outer breaker member 30 starts to move out of engagement with the side of a book, the springs 186 and 188 move the slide 176 forwardly relative to the outer breaker member carrier frame 166. As this occurs, the crank arm 238 and cylindrical member 228 rotate in a clockwise direction, that is in a direction opposite to the arrow 244 in FIG. 14. At the same time, the spring assembly 234 engages the cylindrical body 228 absorbing energy and urges the cylindrical body 228 back toward its initial position relative to the stop block 216.

Motion of the slide 176 away from the front edge portion 184 of the breaker member carrier frame 166 is limited by engagement of a bumper 250 (FIGS. 11 and 13) on the slide with a rear edge portion 252 of the outer breaker member carrier frame 166. The bumper 250 is deformable by engagement with the rear edge portion 252 of the outer breaker member carrier frame.

Conclusion

In view of the foregoing description, it is apparent that the present invention provides a new and improved cover breaker assembly 20 for use in applying covers to books 32 of different thicknesses or to books of the same thickness. The cover breaker assembly has inner and outer breaker members which are sequentially moved into engagement with a cover on a book 32. Thereafter, the breaker members 28 and 30 are moved in the same direction and at nearly the same speed as the book 32.

One of the breakers members, which is the inner breaker member 28, is moved into engagement with a side of the book at the same location and is then moved forward with the book through the same distance regardless of whether the book is a thin book **32*a* or a thick book 32*b*. The other breaker member, which is the outer breaker member 30, engages the book at a different location and is moved forward with the book through a distance which varies depending upon whether the book is a thin book 32*a* or a thick book 32*b*. Thus, if the book is a thin book 32*a*, the second breaker member 30 engages the book and moves through a short distance with the book. However, if the book is a thick book 32*b*, the second breaker member 30** engages the book earlier in the operating cycle and then moves through a relatively long distance with the book.

To accommodate the sequential application of covers to books 32 of different thicknesses and to apply the same force to the books of different thicknesses, the second breaker member, which is the outer breaker member 30, is movable relative to a carrier 166 against the influence of a biasing force. The second breaker member 30 is moved relative to the carrier 166 after the second breaker member has engaged the book.

It should be understood that the breaker members 28 and 30 are considered as moving at the same speed as book 32 even though the speed of the breaker members 28 and 30 may not be precisely the same as the speed of the book 32. Any slight difference between the speeds of the breaker members 28 and 30 and the speed of the book 32 is so small as to be negligible. It should also be understood that the force applied against the cover of a thick book 32*b* is somewhat greater than the force applied against the cover of a thin book 32. This is because the thick book causes greater compression of the springs 186 and 188. Within the range of thicknesses of the books 32*a* and 32*b*, the increased compression of the springs 186 and 188 causes such a small increase in force as to be negligible.

Having described the invention, the following is claimed:

1. A method of sequentially applying covers to a series of books of different thicknesses, said method comprising the steps of engaging a cover on a thin book with a first breaker member, moving a second breaker member from a retracted position through a first distance into engagement with the cover on the thin book, thereafter, engaging a cover on the next book in the series of books with the first breaker member, said next book being a thick book which is thicker than the thin book, and moving the second breaker member from the retracted position through a second distance into engagement with the cover on the thick book, said second distance being less than said first distance.

2. A method as set forth in claim 1 wherein said step of moving the second breaker member into engagement with the cover on the thin book includes pressing the second breaker member against the cover on the relatively thin book with a force of a first magnitude, said step of moving the second breaker member into engagement with the cover on the thick book includes pressing the second breaker member against the cover on the relatively thick book with a force which is at least substantially of the first magnitude.

3. A method as set forth in claim 1 wherein said step of engaging a cover on a thin book with the first breaker member includes moving the first breaker member from a retracted position through a third distance into engagement with the cover on the thin book, said step of engaging a cover on a thick book with the first breaker member includes moving the first breaker member from the retracted position through the third distance into engagement with the cover on the thick book.

4. A method as set forth in claim 1 wherein said step of moving a second breaker member into engagement with the cover on the thin book is performed after said step of engaging a cover on the thin book with the first breaker member.

5. A method as set forth in claim 1 further including the step of moving the first breaker member and the thin book together in a first direction after performing said step of engaging the cover on the thin book with the first breaker member, said step of moving the second breaker member into engagement with the cover on the thin book being performed while the first breaker member and the thin book are moving together in the first direction.

6. A method as set forth in claim 1 further including the steps of moving the first breaker member and the thick book together in a first direction after performing said step of engaging the cover on the thick book with the first breaker member, and moving the second breaker member and the thick book together in the first direction after performing said step of engaging the cover on the thick book with the second breaker member.

7. A method of applying covers to books, said method comprising the steps of moving a book in a first direction, moving a first breaker member into engagement with a cover on the book while the book is moving in the first direction, thereafter, moving a second breaker member into engagement with the cover on the book while the book is moving in the first direction and while the first breaker member is moving in the first direction in engagement with the cover on the book, and thereafter, moving the first and second breaker members in the first direction and at the same speed as the book while maintaining the first and second breaker members in engagement with the cover on the book.

8. A method as set forth in claim 7 wherein said step of moving a first breaker member into engagement with a cover on the book while the book is moving in the first direction includes moving the first breaker member along a first arcuate path into engagement with the cover, thereafter, moving the first breaker member in the first direction along a linear path at the same speed as the book and with the first breaker member in engagement with the cover on the book, said step of moving the second breaker member into engagement with the cover on the book while the book is moving in the first direction includes moving the second breaker member along a second arcuate path into engagement with the cover, thereafter, moving the second breaker member in the first direction along the linear path at the same speed as the book with the first and second breaker members in engagement with the cover on the book.

9. A method as set forth in claim 7 wherein said first breaker member is moved through a first distance in the first direction while said first breaker member is in engagement with the cover on the book and said second breaker member is moved through a second distance in the first direction while said second breaker member is in engagement with the cover on the book, said first distance being greater than said second distance.

10. A method of applying covers to books, said method comprising the steps of moving a first book in a first direction along a path which extends between first and second breaker members, moving the first breaker member along a first continuous path having an arcuate segment and a linear segment which extends between opposite ends of the arcuate segment of the first continuous path, moving the second breaker member along a second continuous path having an arcuate segment and a linear segment which extends between opposite ends of the arcuate segment of the second continuous path, moving the first breaker member into engagement with the cover on the first book as the first breaker member moves from the arcuate segment to the linear segment of the first continuous path and as the first book moves in the first direction along the path extending between the first and second breaker members, moving the second breaker member into engagement with the cover on the first book as the second breaker member moves from the arcuate segment to the linear segment of the second continuous path and as the first book moves in the first direction along the path extending between the first and second breaker members, thereafter, simultaneously moving the first breaker member along at least a portion of the linear segment of the first continuous path and the second breaker member along at least a portion of the linear segment of the second continuous path with the first and second breaker members in engagement with the cover on the first book as the first book moves in the first direction along the path extending between the first and second breaker members, thereafter, moving the first breaker member out of engagement with the cover on the first book as the first breaker member moves from the linear segment to the arcuate segment of the first continuous path and as the first book moves in the first direction along the path extending between the first and second breaker members, and moving the second breaker member out of engagement with the cover on the first book as the second breaker member moves from the linear segment to the arcuate segment of the second continuous path and as the first book moves in the first direction along the path extending between the first and second breaker members.

11. A method as set forth in claim 10 further including the steps of moving a second book in the first direction along the path which extends between the first and second breaker members, the second book having a thickness which is different than the thickness of the first book, moving the first breaker member into engagement with a cover on the second book as the first breaker member moves from the arcuate segment to the linear segment of the first continuous path and as the second book moves in the first direction along the path extending between the first and second breaker members, moving the second breaker member into engagement with the cover on the second book as the second breaker member moves from the arcuate segment to the linear segment of the second continuous path and as the second book moves in the first direction along the path extending between the first and second breaker members, thereafter, simultaneously moving the first breaker member along at least a portion of the linear segment of the first continuous path and the second breaker member along at least a portion of the linear segment of the second continuous path with the first and second breaker members in engagement with the cover on the second book as the second book moves in the first direction along the path extending between the first and second breaker members, said step of simultaneously moving the first breaker member along at least a portion of the linear segment of the first continuous path and the second breaker member along at least a portion of the linear segment of the second continuous path with the first and second breaker members in engagement with the cover on the second book includes moving the first and second breaker members in the first direction along the path extending between the first and second breaker members through a distance which is greater than a distance which the first and second breaker members are moved in the first direction along the path extending between the first and second breaker members during performance of said step of simultaneously moving the first breaker member along at least a portion of the linear segment of the first continuous path and the second breaker member along at least a portion of the linear segment of the second continuous path with the first and second breaker members in engagement with the cover on the first book.

12. A method as set forth in claim 10 further including the steps of moving a second book in the first direction along the path which extends between the first and second breaker members, the second book having a thickness which is different than the thickness of the first book, moving the first breaker member into engagement with a cover on the second book as the first breaker member moves from the arcuate segment to the linear segment of the first continuous path and as the second book moves in the first direction along the path extending between the first and second breaker members, moving the second breaker member into engagement with the cover on the second book as the second breaker member moves from the arcuate segment to the linear segment of the second continuous path and as the second book moves in the first direction along the path extending between the first and second breaker members, thereafter, simultaneously moving the first breaker member along at least a portion of the linear segment of the first continuous path and the second breaker member along at least a portion of the linear segment of the second continuous path with the first and second breaker members in engagement with the cover on the second book as the second book moves in the first direction along the path extending between the first and second breaker members, said step of moving the second breaker member into engagement with the cover on the first book occurring at a first location along the linear segment of the first continuous path, said step of moving the second breaker member into engagement with the cover on the second book occurring at a second location along the linear segment of the first continuous path, the second location along the linear segment of the first continuous path being spaced from the first location along the linear segment of the first continuous path.

13. A method as set forth in claim 10 further including the steps of moving a second book in the first direction along the path which extends between the first and second breaker members, the second book having a thickness which is different than the thickness of the first book, moving the first breaker member into engagement with a cover on the second book as the first breaker member moves from the arcuate segment to the linear segment of the first continuous path and as the second book moves in the first direction along the path extending between the first and second breaker members, moving the second breaker member into engagement with the cover on the second book as the second breaker member moves from the arcuate segment to the linear segment of the second continuous path and as the second book moves in the first direction along the path extending between the first and second breaker members, thereafter, simultaneously moving the first breaker member along at least a portion of the linear segment of the first continuous path and the second breaker member along at least a portion of the linear segment of the second continuous path with the first and second breaker members in engagement with the cover on the second book as the second book moves in the first direction along the path extending between the first and second breaker members, the linear segment of the second continuous path having a first length during movement of the first book along the path extending between the first and second breaker members and having a second length which is different than the first length during movement of the second book along the path extending between the first and second breaker members.

14. A method as set forth in claim 13 wherein the linear segment of the first continuous path has the same length during movement of the first book along the path extending between the first and second breaker members as during movement of the second book along the path extending between the first and second breaker members.

15. A method as set forth in claim 10 wherein said step of moving the second breaker member into engagement with the cover is performed after performance of said step of moving the first breaker member into engagement with the cover.

16. A method as set forth in claim 15 wherein said step of moving the first breaker member out of engagement with cover is performed after performance of said step of moving the second breaker member out of engagement with the cover member.

17. A method as set forth in claim 10 wherein said step of moving the first breaker member into engagement with the cover on the first book includes moving the first breaker member in one direction along the arcuate segment of the first continuous path through a first arcuate distance from a first retracted position to a first end of the linear segment of the first continuous path, said step of moving the first breaker member out of engagement with the cover on the first book includes moving the first breaker member in the one direction along the arcuate segment of the first continuous path through the first arcuate distance from a second end of the first linear path to the first retracted position, said step of moving the second breaker member into engagement with the cover on the first book includes moving the second breaker member in a direction opposite to the one direction along the arcuate segment of the second continuous path through a second arcuate distance from a second retracted position to a first end of the linear segment of the second continuous path, said step of moving the second breaker member out of engagement with the cover on the first book includes moving the second breaker member in the direction opposite to the one direction along the arcuate segment of the second continuous path through the second arcuate distance from a second end of the linear segment of the second continuous path to the second retracted position, the first arcuate distance being smaller than the second arcuate distance.

18. A method as set forth in claim 10 wherein said step of moving the first breaker member into engagement with the cover on the first book includes moving the first breaker member in one direction along the arcuate segment of the first continuous path from a first retracted position to a first end of the linear segment of the first continuous path, said step of moving the first breaker member out of engagement with the cover on the first book includes moving the first breaker member in the one direction along the arcuate segment of the first continuous path from a second end of the first linear path to the first retracted position, said step of moving the second breaker member into engagement with the cover on the first book includes moving the second breaker member in a direction opposite to the one direction along the arcuate segment of the second continuous path from a second retracted position to a first end of the linear segment of the second continuous path, said step of moving the second breaker member out of engagement with the cover on the first book includes moving the second breaker member in the direction opposite to the one direction along the arcuate segment of the second continuous path from a second end of the linear segment of the second continuous path to the second retracted position.

* * * * *